US011753808B2

(12) United States Patent
Kuru et al.

(10) Patent No.: US 11,753,808 B2
(45) Date of Patent: Sep. 12, 2023

(54) AIR DRIVE SYSTEM FOR A TOILET

(71) Applicant: Kohler Co., Kohler, WI (US)

(72) Inventors: William Kuru, Plymouth, WI (US); Clayton Garrels, Kohler, WI (US); Jeremiah Rauwerdink, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 71 days.

(21) Appl. No.: 17/410,238

(22) Filed: Aug. 24, 2021

(65) Prior Publication Data

US 2022/0074183 A1 Mar. 10, 2022

Related U.S. Application Data

(60) Provisional application No. 63/184,523, filed on May 5, 2021, provisional application No. 63/074,545, filed on Sep. 4, 2020.

(51) Int. Cl.
*E03D 3/10* (2006.01)

(52) U.S. Cl.
CPC ..... *E03D 3/10* (2013.01)

(58) Field of Classification Search
CPC ..... E03D 3/10
USPC ..... 4/362
See application file for complete search history.

(56) References Cited

U.S. PATENT DOCUMENTS

| | | | | |
|---|---|---|---|---|
| 4,183,108 | A | 1/1980 | Hamilton | |
| 4,232,409 | A * | 11/1980 | Van Pham | E03D 5/012 4/380 |
| 5,058,216 | A | 10/1991 | Trayer et al. | |
| 6,360,378 | B2 | 3/2002 | Martin | |
| 6,467,101 | B1 | 10/2002 | Artola | |
| 6,986,172 | B2 | 1/2006 | Hidetaka et al. | |
| 7,565,706 | B2 | 7/2009 | Janssen | |
| 8,142,572 | B2 * | 3/2012 | Shirai | E03D 11/08 4/300 |
| 8,196,231 | B2 | 6/2012 | Hennessy | |
| 10,612,223 | B2 | 4/2020 | Moore | |
| 2009/0151063 | A1 | 6/2009 | Shirai et al. | |
| 2010/0218309 | A1 * | 9/2010 | Mansour | E03D 11/08 4/354 |
| 2010/0275361 | A1 | 11/2010 | Redmond et al. | |

(Continued)

FOREIGN PATENT DOCUMENTS

| | | | |
|---|---|---|---|
| CN | 88211127 | U | 9/1988 |
| CN | 2031420 | U | 1/1989 |
| CN | 1031727 | C | 5/1996 |

(Continued)

OTHER PUBLICATIONS

Extended European Search Report from European Patent Application No. 21193682.8, dated Feb. 18, 2022, 8 pages.

*Primary Examiner* — Christine J Skubinna
(74) *Attorney, Agent, or Firm* — Lempia Summerfield Katz LLC

(57) ABSTRACT

An air drive system for a toilet includes a compression cylinder including an air space, a fluid space, a base orifice adjoining the fluid space, and an outlet orifice adjoining the air space, and an air drive passage configured to carry pressurized air to the toilet. The flow of water increases the fluid space of the compression cylinder or increases an air pressure associated with the air space of the compression cylinder.

19 Claims, 30 Drawing Sheets

(56) References Cited

U.S. PATENT DOCUMENTS

| | | | | |
|---|---|---|---|---|
| 2015/0033463 | A1 | 2/2015 | Roeser | |
| 2018/0073231 | A1* | 3/2018 | Smith | E03D 1/283 |

FOREIGN PATENT DOCUMENTS

| | | | |
|---|---|---|---|
| CN | 2447420 | Y | 9/2001 |
| CN | 1448593 | A | 10/2003 |
| CN | 1176279 | C | 11/2004 |
| CN | 2704630 | Y | 6/2005 |
| CN | 101492931 | A | 7/2009 |
| CN | 201521011 | U | 7/2010 |
| CN | 201785837 | U | 4/2011 |
| CN | 102425223 | A | 4/2012 |
| CN | 202214793 | U | 5/2012 |
| CN | 202273300 | U | 6/2012 |
| CN | 203546857 | U | 4/2014 |
| CN | 203684357 | U | 7/2014 |
| CN | 106120993 | A | 11/2016 |
| CN | 110439073 | A | 11/2019 |
| GB | 1093277 | A | 11/1967 |
| JP | 2005048430 | A | 2/2005 |
| JP | 2005120742 | A | 5/2005 |
| JP | 2006241698 | A | 9/2006 |
| JP | 2007046308 | A | 2/2007 |
| JP | 2007247282 | A | 9/2007 |
| JP | 4052085 | B2 | 12/2007 |
| JP | 2008156937 | A | 7/2008 |
| JP | 4305359 | B2 | 5/2009 |
| JP | 4305360 | B2 | 5/2009 |
| JP | 4424123 | B2 | 12/2009 |
| JP | 2010024721 | A | 2/2010 |
| JP | 4517848 | B2 | 5/2010 |
| JP | 4517975 | B2 | 5/2010 |
| JP | 4517978 | B2 | 5/2010 |
| JP | 5371280 | B2 | 9/2013 |
| RU | 2131499 | C1 | 6/1999 |
| WO | 2008060067 | A1 | 5/2008 |
| WO | 2012071022 | A9 | 11/2012 |

* cited by examiner

AIR DRIVE SYSTEM FOR A TOILET

CROSS-REFERENCE TO RELATED APPLICATIONS

This application claims priority benefit to U.S. Provisional Utility Application Ser. No. 63/074,545 entitled "AIR DRIVE ACTUATOR FOR A TOILET," filed on Sep. 4, 2020, and U.S. Provisional Utility Application Ser. No. 63/184,523 entitled "AIR DRIVE SYSTEM FOR A TOILET," filed on May 5, 2021. The entire disclosure of each is hereby incorporated by reference.

FIELD

The following disclosure relates to a toilet, an air drive system for a toilet, and a method for flushing a toilet.

BACKGROUND

In a siphonic flush toilet, the flush may be initiated with a lever or a push button. Water may be released, which displaces air in a trapway to form a vacuum and cause a siphon to quickly cause the water to flow from the bowl and out of the toilet, removing any contents of the toilet with the escaping water. Toilets that primarily operate under water pressure (e.g., line pressure) may create such a siphon effect to produce using the water pressure. However, the siphon effect may have certain requirements for the line pressure in order for the siphon effect to be effective. What is needed is an additional drive system for improving or augmenting the siphon affect.

In addition, sanitary facilities, such as toilets, sinks, showers, plumbing fixtures, and sanitary systems, may be vectors for the transmission of disease. A risk of transmitting disease may increase with increased use. Traditionally, aerosolizing the water or disinfectant requires electricity. For example, a connection to an electrical main (e.g. at 120 or 220 volts) or a battery may provide electricity to aerosolize the water or disinfectant. However, using electricity for aerosolization increases risks and complexity. For example, sanitary facilities may contain wet surfaces, and users of the facilities may have wet hands. The presence of electricity alongside water in the sanitary facility presents a risk of electric shock from the electricity used for aerosolization. Isolating the electricity from any water adds complexity to the aerosolization. For example, additional shielding may be added to the connection to the electrical mains to increase water-resistance. In another example, a waterproof compartment may house batteries. In both examples, increasing the safety of the electrical supply increases cost and complexity.

Beyond aerosolization, one or more devices such as a bidet (e.g. including a water heater), a self-closing seat, a flush assist device, or an air freshener may be powered by electricity. These additional electrically powered devices present similar safety risks and complications as electrically powered aerosolizers. What is needed is an alternative drive system for powering the aerosolizer, bidet, self-closing seat, flush assist device, air freshener, and other devices present in the sanitary facility.

SUMMARY

In at least one example embodiment, an air drive system for a toilet includes a chamber including an air space, a base orifice of the chamber in fluid communication with the air space, an outlet orifice of the chamber adjacent to the air space, a water passage configured to carry a flow of water to the base orifice, wherein the flow of water increases an air pressure associated with the air space, and an air drive passage configured to supply pressurized air from the chamber to a toilet.

The air drive system may include a fluid space of the chamber, wherein the base orifice adjoins the fluid space, and wherein the flow of water increases a volume of the fluid space of the chamber.

The air drive system may include a float between the fluid space and the air space in the chamber, wherein the float moves in response to the increase in the fluid space in the chamber, and wherein the float actuates a valve to supply air from the air space of the chamber to the air drive passage.

The air drive system may include a vent in fluid communication with the air drive passage, wherein the vent is configured to release the pressurized air from the air drive passage.

The air drive system may include a sump disposed at a bottom of a bowl of the toilet and configured to store a first volume of water and a trap of the toilet in fluid communication with the sump, wherein the trap is configured to store a second volume of water providing a sanitary seal for the toilet. In the air drive system, the air drive passage is configured to supply pressurized air from the chamber to move at least a portion of the first volume of water from the sump to the trap. The first volume of water displaces the second volume of water to break the sanitary seal to flush the toilet. The water passage is configured to provide the first volume of water to the sump from the flow of water carried by the water passage.

The air drive system may include a rim jet in fluid communication with the water passage and adjacent to the bowl, wherein the water passage is configured to supply the first volume of water to the bowl or the sump through the rim jet. The first volume of water stored in the sump is greater than the second volume of water disposed in the trap. The trap comprises a first pipe section, a vertical section, and an outlet pipe, wherein a space in the vertical section, at least partially, defines the volume of the sanitary seal. The pressurized air from the chamber is provided to the toilet in response to a user input or a flush cycle.

The air drive system may include a jet in fluid communication with the air drive passage to provide the pressurized air to flush the toilet.

In at least one example embodiment, a method for flushing a toilet includes supplying a flow of water to a base opening of a compression cylinder, wherein the flow of water increases air pressure in an air space of the compression cylinder, opening an outlet orifice adjoining the air space, and providing, in response to opening the outlet orifice, a flow of air through an air drive passage to an air driven device associated with the toilet.

The outlet orifice is opened in response to a user input. The air driven device is an air jet for flushing the toilet. The air driven device breaks a siphon seal. The flow of water is provided, at least in part, to a rim aperture.

In at least one example embodiment, a toilet includes a chamber with an air space, a base orifice of the chamber in fluid communication with the air space, an outlet orifice of the chamber adjacent to the air space, a water passage configured to provide water to the chamber, wherein the water increases an air pressure associated with the air space, and an air drive passage configured to supply pressurized air from the chamber to flush the toilet.

In at least one example embodiment, an air drive system for a toilet includes a first chamber, an air space disposed in the first chamber, a base orifice of the first chamber in fluid communication with the air space, an outlet orifice of the first chamber adjacent to the air space, a water passage configured to carry a flow of water past the base orifice, wherein the flow of water increases an air pressure associated with the air space, and an air drive passage configured to supply pressurized air from the first chamber to an accessory associated with a toilet.

The air drive system may also include a fluid space of the first chamber, wherein the base orifice adjoins the fluid space, and wherein the flow of water increases a volume of the fluid space of the first chamber and a float between the fluid space and the air space in the first chamber, wherein the float moves in response to the increase in the fluid space in the first chamber, and wherein the float actuates a valve to supply air from the air space of the first chamber to the air drive passage.

The air drive system may also include a vent in fluid communication with the air drive passage, wherein the vent is configured to release the pressurized air from the air drive passage.

The air drive system may also include a piston chamber in fluid communication with an air timing space and the air drive passage; and a piston disposed in the piston chamber and extending into the air timing space, wherein the piston is configured to move from a first position to a second position when air enters the piston chamber, and wherein, when the piston is in the second position, the pressurized air from the first chamber is supplied to a jet.

The air drive system may also include a vent in fluid communication with the air drive passage, wherein the vent is configured to release the pressurized air from the air drive passage when the piston is in the first position.

The air drive system may also a second chamber, an air timing space of the second chamber, and a base timing orifice in fluid communication with the air timing space, wherein the water passage is configured to carry the flow of water past the base timing orifice of the second chamber, wherein the flow of water increases an air pressure associated with the air timing space of the second chamber, and an outlet timing orifice adjacent to the air timing space and in fluid communication with the air drive passage, wherein the second chamber is configured to control a timing of the pressurized air supplied to the air drive device.

The air drive system may also include a second chamber, a second air space disposed in the second chamber, a second base orifice of the second chamber in fluid communication with the second air space, an outlet orifice of the second chamber adjacent to the second air space, wherein the water passage is configured to carry a flow of water past the second base orifice, wherein the flow of water increases an air pressure associated with the second air space, and wherein the air drive passage is configured to supply pressurized air from the first chamber and the second chamber to the accessory.

The air drive system may also a third chamber, an air timing space disposed in the third chamber, a base timing orifice in fluid communication with the air timing space, wherein the water passage is configured to carry the flow of water past the base timing orifice of the third chamber, wherein the flow of water increases an air pressure associated with the air timing space of the third chamber, and an outlet timing orifice adjacent to the air timing space and in fluid communication with the air drive passage, wherein the third chamber is configured to control a timing of the pressurized air supplied to the accessory from the first chamber and the second chamber.

The air drive system may also include a second chamber, a first air timing space disposed in the second chamber, a first base timing orifice in fluid communication with the first air timing space, wherein the water passage is configured to carry the flow of water past the first base timing orifice of the second chamber, wherein the flow of water increases an air pressure associated with the first air timing space of the second chamber, an outlet timing orifice adjacent to the first air timing space and in fluid communication with the air drive passage, a third chamber, a second air timing space disposed in the third chamber, a second base timing orifice in fluid communication with the second air timing space, wherein the water passage is configured to carry the flow of water past the second base timing orifice of the third chamber, wherein the flow of water increases an air pressure associated with the second air timing space of the third chamber, and an outlet timing orifice adjacent to the air timing space and in fluid communication with the air drive passage, wherein the second chamber and the third chamber are configured to independently control a timing of the pressurized air supplied to the accessory from the first chamber.

The air drive system may also include a sump disposed at a bottom of a bowl of the toilet and to store a first volume of water, a trap of the toilet in fluid communication with the sump, wherein the trap is configured to store a second volume of water providing a sanitary seal for the toilet, wherein the accessory comprises a siphoning jet in fluid communication with the air drive passage and configured to provide the pressurized air to the chamber, and wherein, when the pressurized air is supplied to the chamber, the first volume of water is expelled from the sump into the trap and the bowl is drained through the trap. The water passage is configured to provide the first volume of water to the sump from the flow of water carried by the water passage.

The air drive system may also include a rim jet in fluid communication with the water passage and adjacent to the bowl, wherein the water passage is configured to supply the first volume of water to the sump through the rim jet. The rim jet may be configured to direct the first volume toward the bowl. The first volume of water stored in the sump may be greater than the second volume of a disposed in the trap. The trap may include a first pipe section a vertical pipe section, and an outlet pipe, wherein a space in the vertical pipe section defines the volume of the sanitary seal.

The pressurized air from the first chamber is provided to the accessory associated with the toilet in response to a flush cycle. The bowl may include an outlet opening in fluid communication with the sump, and wherein the bowl is drained through the outlet opening.

The air drive system of may include a rim, wherein an inner wall extending from the rim downward to the sump defines an extent of the bowl. The inner wall may include an outlet opening providing for fluid communication between the bowl and the sump.

The air drive system may also include a seat, wherein the accessory comprises a pneumatic solenoid mechanically coupled to the seat and in fluid communication with the air drive passage. The pneumatic solenoid is configured to move from a first position to a second position when the pressurized air is supplied to the pneumatic solenoid. The pneumatic solenoid is in the second position, the pneumatic solenoid is configured to transmit a mechanical force to the seat and move the seat to a closed position.

The air drive system may also include a brake having a mechanical connection to the seat and the pneumatic solenoid, wherein the pneumatic solenoid is mechanically coupled to the seat via the brake, wherein, when the pneumatic solenoid is in the first position the brake is actuated and configured to hold the seat in an open position, and wherein, when the pneumatic solenoid is in the second position, the brake is released and the seat is configured to move to a closed position. An angle between a first axis defined by a major axis of the seat in the open position and a second axis extending vertically through the toilet may be greater than or equal to a threshold fall angle.

The air drive system may also include a plunger rigidly secured to the pneumatic solenoid and configured to move with the pneumatic solenoid, wherein, when the pneumatic solenoid is in the second position, the plunger is configured to transmit a mechanical force to the seat and advance the seat toward a closed position. An angle between a first axis defined by a major axis of the seat in an open position and a second axis extending vertically through the toilet may be greater than or equal to a threshold fall angle.

The air drive system may include a seat that is rotatable between an open position and a closed position, wherein, when the seat is in the closed position, the seat is adjacent to a rim of a bowl of the toilet, and wherein, when the seat is in the open position, the seat is nonadjacent to the rim. The seat is configured to support a user in a closed position. The seat is secured to the toilet by a hinge base.

The air drive system may also include an auxiliary pipe in fluid communication with the water passage, wherein the auxiliary pipe is configured to supply the flow of water to a wet accessory, wherein the air drive device comprises an auxiliary valve in fluid communication with the air drive passage and the auxiliary pipe, wherein the auxiliary valve is configured to move from a first position to a second position when the pressurized air is supplied to the air drive passage, wherein the auxiliary valve is configured to restrict the flow of water to the wet accessory in the first position, and wherein the auxiliary valve is configured to open the flow of water to the wet accessory in the second position.

The wet accessory may include a water dispenser, wherein the water dispenser is configured to emit the flow of water supplied by the auxiliary pipe to the wet accessory. The air drive system may also include a nozzle in fluid communication with the water dispenser and configured to direct the flow of water toward a user of the toilet.

The air drive system may also include a cover pivotably coupled to the toilet or a seat of the toilet and configured to shield the water dispenser. The cover may be rotatable between a first position and a second position, wherein the cover is configured to shield the nozzle in the first position, and wherein the cover is configured to be disposed away from a water discharge path of the nozzle in the second position. The nozzle of the air drive system may be rigidly coupled to the toilet. The nozzle may be fluidly connected to the water dispenser via a flexible hose.

The air drive system may also include a wand in fluid communication with the flexible hose and the nozzle, wherein the nozzle is disposed on the wand.

The air drive system may also include a regulator configured to control a pressure or direction of the flow of water output by the nozzle. Based on a setting of the regulator, the direction of the flow of water output by the nozzle is varied between a first direction and a second direction.

The air drive system may also include a mister, wherein the mister is configured to emit the flow of water as a mist applied to a surface of the toilet. The mister may be rigidly secured to the toilet. The mister is configured to direct the mist at an interior surface of a bowl of the toilet. The mister is configured to direct the mist at a seat of the toilet.

The air drive system may also include an auxiliary fluid storage compartment containing an auxiliary fluid, wherein the auxiliary fluid storage compartment is in fluid communication with the mister, and wherein the mister is configured to dispense the auxiliary fluid as a mist in addition to the flow of water. The auxiliary fluid may include a disinfectant, a fragrance, or the disinfectant and the fragrance. The auxiliary fluid may include hydrogen peroxide.

The air drive system may also include an interface rigidly secured to the toilet and configured to receive the auxiliary fluid storage compartment, wherein the auxiliary fluid storage compartment is severable from the interface. The air drive system may also include a fill neck in fluid communication with the auxiliary fluid storage compartment.

The mister of the air drive system may include a fluidic oscillator. The fluidic oscillator may include an inlet in fluid communication with the flow of water, a chamber in fluid communication with the inlet, an outlet in fluid communication with the chamber, and a plurality of feedback channels disposed in the chamber between the inlet and the outlet.

The air drive system may also include a fan, wherein the accessory comprises a pneumatic solenoid mechanically coupled to the fan and in fluid communication with the air drive passage.

The air drive system may also include a flywheel mechanically coupled to the fan and the pneumatic solenoid, wherein the pneumatic solenoid is configured to move from a first position to a second position when the pressurized air is supplied to the pneumatic solenoid. The rotational movement of the flywheel is provided by movement of the pneumatic solenoid between the first position and the second position. The fan may be configured to rotate with the flywheel.

The air drive system may also include a housing at least partially enclosing the fan; and an outlet disposed on the housing, wherein the outlet is directed toward an interior surface of a bowl or a seat of the toilet.

The air drive system may also include an auxiliary fluid storage compartment containing an auxiliary fluid, wherein the accessory comprises an atomizer, wherein the auxiliary fluid storage compartment is in fluid communication with the atomizer, wherein the atomizer is in fluid communication with the air drive passage and configured to provide the pressurized air to the atomizer, and wherein the atomizer is configured to dispense the auxiliary fluid in an atomized form when the pressurized air is supplied to the atomizer. The fluid may include a disinfectant, a fragrance, or the disinfectant and the fragrance. The fluid may include hydrogen peroxide. An outlet of the atomizer may be directed toward an interior surface of a bowl or a seat of the toilet.

In one embodiment, a method for flushing a toilet includes supplying a flow of water through a passthrough passage past a base opening of a compression cylinder, increasing a fluid space of the compression cylinder or an air pressure associated with an air space of the compression cylinder in response to the flow of water, opening an outlet orifice adjoining the air space in response to the increase in the fluid space or the air pressure of the air space, and providing, in response to opening the outlet orifice, a flow of air through an air drive passage to an air driven device associated with the toilet.

In one embodiment, a toilet includes a bowl, a rim jet associated with a top of the bowl, a siphon jet associated with a bottom of the bowl, a first chamber, an air space disposed in the first chamber, a base orifice of the first chamber in fluid communication with the air space, an outlet orifice of the first chamber adjacent to the air space, a water passage configured to carry a flow of water past the base orifice, wherein the flow of water increases an air pressure associated with the air space, and an air drive passage configured to supply pressurized air from the first chamber to an accessory associated with a toilet.

BRIEF DESCRIPTION OF THE DRAWINGS

Exemplary embodiments of the present invention are described herein with reference to the following drawings.

DETAILED DESCRIPTION

Figure 1A:
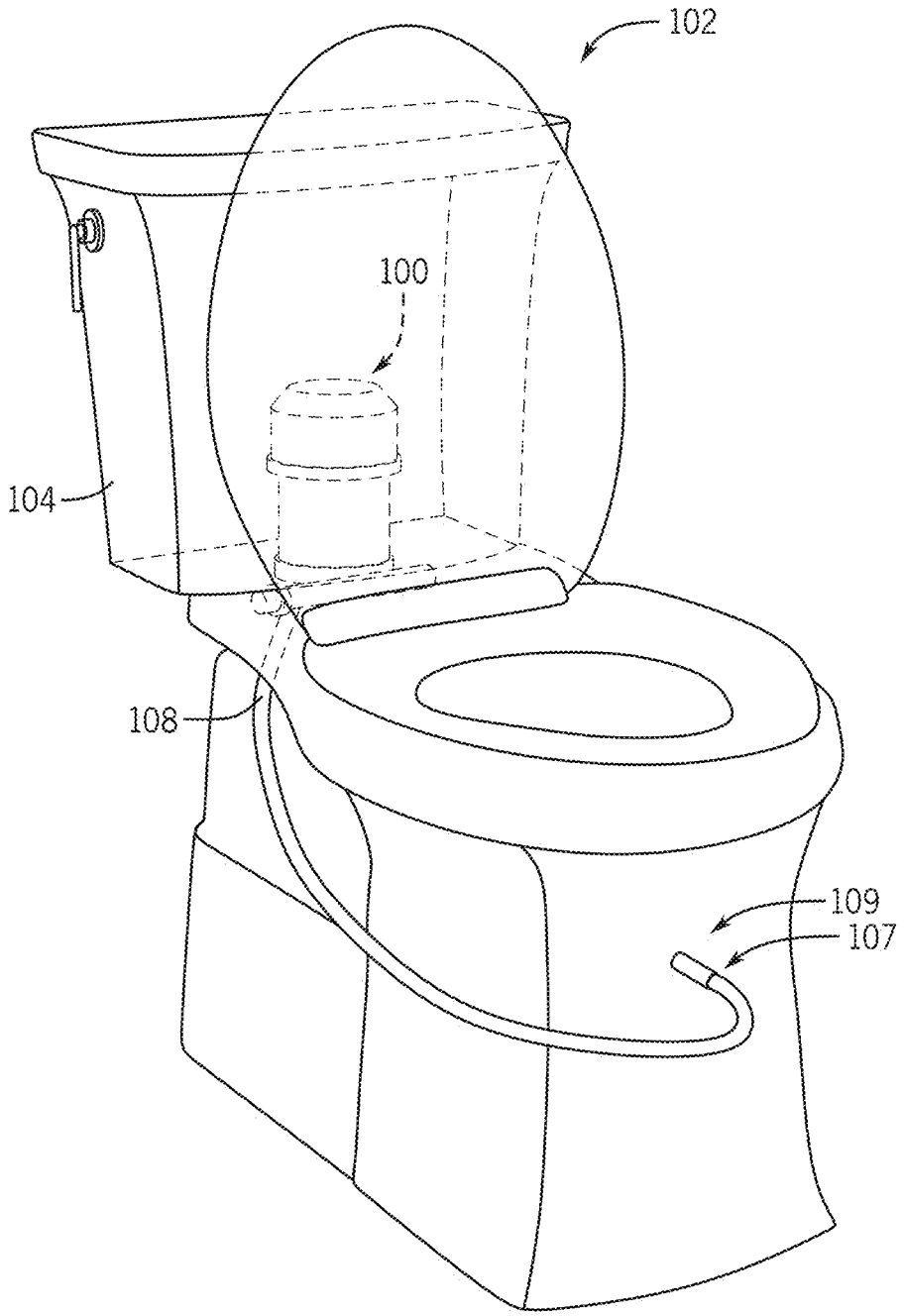
FIG. 1A illustrates an example toilet with an air drive system.

The following embodiments include improvements to several technologies related to the toilet. One improvement is to the flushing process or flushing cycle of the toilet. Various types of toilets and other devices may rely on the siphon effect to induce a flushing action in the toilet. Some embodiments of the disclosure harness pressure in the flow of water through the toilet to actuate one or more accessories or devices in the sanitary facility.

For example, the water pressure, such as from the water flowing to the rim of the toilet, may be used to store pressurized air and/or water and drive a subsequent portion of the flush cycle, such as breaking the siphon in a trapway of the toilet. In another example, the water pressure or pressurized air produced from the water may drive an opening and/or closing action of a toilet seat. In a further example, the water pressure or pressurized air produced from the water may drive one or more functions of a bidet, such as a water spray, a fragrance spray, and/or a sanitary spray. In still another example, an air freshener, such as a device that disperses a fragrance, may be actuated by the water pressure or pressurized air produced from the water. In still a further example, a mister, such as a device that disperses water on a toilet bowl or another part of the toilet, may be actuated by the water pressure or pressurized air produced from the water.

In a first type, the toilet may include a tank or reservoir, which holds a predetermined supply of water and is positioned above the toilet bowl. When a flush is activated, water flows from the tank due to gravity and is led through internal passages provided in the bowl to both rinse the inner surface of the bowl and prime the bowl for siphoning. A jet located in a sump or chamber of the bowl primes the siphon by delivering the water from the tank into the sump and a trapway, which provides the necessary suction for evacuating the bowl once the siphon action (e.g., siphoning) is induced. After completion of the flush, the tank is refilled and the sump is filled with additional water to seal the trapway. In these gravity-based designs, a high flow rate of water from the tank into the trapway is necessary to provide sufficient priming for the siphon. In a second type, a toilet may be provided without a tank (e.g., a "tankless" toilet). One or more of the following techniques may be applied to tankless toilets.

The toilet may include a seat that may be moved between an open position and a closed position, for example, without the user manually lifting or lowering the seat. One or more conditions may trigger the seat to open, such as a user approaching or the toilet, a press of a button or surface, a gesture, the toilet bowl flushing, or other input. In response to the condition, the seat may automatically open or close.

The toilet may include one or more bidet functions, such as dispensing water or a stream of air, fragrance, or sanitation. For example, water may be directed at the bowl before, during, or after use to prevent, reduce, or eliminate accumulation of dirt in the toilet bowl. In another example, a stream of air may be directed at a user. In another example, fragrance may be dispensed in and around the toilet. In a further example, sanitizing liquid may be dispensed in the toilet bowl in between uses.

Other technologies of the toilet may also be improved. For example, the following embodiments may be applied to cleaning, disinfecting, or sanitizing the toilet and the area around the toilet. Cleaning a sanitary facility, for example, a toilet, a sink, a shower, a bathtub, or a jetted tub (e.g. a "whirlpool"), between users (e.g. before a user and/or after a user) may reduce the risk of disease transmission. The interior or seat of a toilet may be disinfected, for example, by misting or aerosolizing water or disinfectant on parts of the toilet.

Traditionally, functions of the toilet (e.g. a jet, automatic seat, bidet, and aerosolized disinfection) require electricity. For example, a connection to an electrical main (e.g. at 120 or 220 volts) or a battery may provide electricity to operate the toilet function. However, using electricity increases risks and complexity. For example, sanitary facilities may contain wet surfaces, and users of the facilities may have wet hands. The presence of water in the sanitary facility may present a risk of electric shock from the electricity used for the functions. Isolating the electricity from any water adds complexity to the operation and implementation of the functions. For example, additional shielding may be added to the connection to the electrical mains to increase water-resistance. In another example, a waterproof compartment may house the batteries.

Complexity and risk may be reduced by using other energy sources for the functions. For example, the pressure of the water supply connected to the sanitary facility may provide a source of energy for opening or closing the toilet seat, dispensing water, providing a stream of air, dispensing fragrance, or aerosolizing disinfectant. Using the pressure in the water supply instead of electricity may eliminate the risk of electrical shock and the accompanying shielding and isolation of electronic connections. For example, operation of the functions may be regulated and synchronized by air and/or water valves opening and closing, instead of using electricity. In another example, using pressure in the water supply to drive the functions may eliminate changing batteries when the batteries are discharged. Because many sanitary facilities already include a connection to a water supply, an aerosolizer actuated by the pressure of the water supply may be easily and seamlessly integrated into sanitary facilities.

The water supply to a toilet includes pressurized water. The pressure of the water supply, or even the pressure of water falling under the force of gravity, may generate pressurized air. The conversion of water pressure to air pressure may be accomplished based on the operating principle of a trompe. A water inlet pipe may supply water with mixed with air. The air may be introduced into the flow of water by an air inlet. The water from the inlet pipe may pass a chamber. When the water passes the chamber, the air in the water may collect in the chamber at a higher than ambient pressure. A pipe attached to the chamber may direct the compressed air out of the chamber. In some cases, a valve or stopper may restrict the pressurized air out of the chamber to increase the air pressure in the chamber. After the chamber, the water may continue flowing through an outlet pipe. For example, the water may be provided to the toilet bowl through one or more jets or orifices (e.g., fluid oscillators) at the rim of the toilet bowl for the flush cycle of the toilet. The pressurized air is stored in the chamber without interrupting the flow of water to the rim of the toilet bowl for the flush cycle of the toilet.

In some examples, the air drive system may complement an existing tank toilet, or in other examples, the air drive system may provide the water and/or air to a tankless toilet. In these tankless examples, the water to the rim is bypassed around the air drive system and in other examples, the water to the rim is routed through the air drive system. In any of these example, the flush cycle may be initiated when a user of the toilet actuates (e.g., presses) a lever or handle or an automatic flush trigger is detected.

For the tank toilet examples, water stored in the tank of the toilet is released by a cannister or flapper in the tank of the toilet. Some of the water, under pressure, flows into the jetway and into the sump of the toilet to flush the toilet. Some of the water flows to the rim of the toilet to wash the bowl of the toilet. After the water is evacuated from the tank, the flapper or the cannister causes a float to fall, triggering refill of the tank. Some of the following embodiments utilize the flow of water to the rim of the toilet, with or without interrupting the flow of water to the rim of the toilet and into the bowl. In some examples, the flow of water to the toilet may be interrupted by a valve that diverts the flow of water into a pressurizing chamber or tank. The flow of the water may be uninterrupted in other examples where the water flows past the chamber or tank and fills the chamber or tank or otherwise causes pressure to build in the chamber or tank.

The utilization of this flow of water may be for only a predetermined time during the flush cycle (e.g., 1-4 seconds, or less than 2 seconds). During the predetermined time, the flow of water builds pressure on a certain amount of air, and that air is released. The air becomes a pulse of air to a cavity (e.g., in the front of the toilet above the sump jet) and pushes that water down through the sump jet at the bottom of the bowl, to prime the siphon and cause a siphon break. In response to the siphon break, water flows through the trapway and empties the bowl of the toilet. During this time, including the predetermined time when the air is pressurized, the water to the rim may not stop. That is, the water is not diverted and may constantly flowing to the rim throughout this process.

A variety of pressures may be used for the water supply for the toilet. The pressure may be lower than typically required or recommended for toilet flushing. One example water pressure is 20 psi (pound force per square inch).

Using these techniques, pressurized air is stored, in a chamber, from the flow of water to the rim of the toilet. The pressurized air in the chamber may be released to drive flushing the toilet. For example, the chamber may be connected to a siphon jet. The pressure to suction wastewater from the bowl during the flush cycle.

In other embodiments, the air from the chamber operates accessories. For example, a nozzle (e.g., mister or atomizer) may be in fluid communication with the pressurized air to produce a "dry fog" of the water or disinfectant. The dry fog may have a lower tendency to wet the surfaces of the sanitary facility and a greater ability to diffuse into small passageways. Compared to basic misting devices, the dry fog may produce increased coverage and dispersal of the water or disinfectant.

Beyond aerosolization (e.g., by an atomizer) and siphoning the trapway of the toilet, the pressurized air generated by action of the water supply may be used to perform other functions for the sanitary facility. For example, the pressurized air may drive the opening or closing of the toilet seat. In another example, the pressure may provide pressure for one or more functions of a bidet. The bidet may include a water tank pressurized by the pressure of the air drive device. The bidet may include a dryer driven by the pressurized air or a bidet water flow driven by the pressurized air. In other examples, the air drive device includes a chamber that is configured to hold a cleaning compound including a chemical compound and water, and the cleaning compound is configured to be dispensed into a bowl of the toilet under the pressurized air. The air drive device may include a self-closing seat configured to close under the pressurized air. The air drive device may provide pressure to a self-closing seat that includes a pneumatic solenoid to close or open a seat of the toilet.

FIG. 1A illustrates an example placement of the air drive system 100 disposed within a tank 104 of a toilet 102. When a level is pressed, a flapper or cannister in the tank 104 raises and water flows into a jetway 108. By disposing the air drive system 100 inside the tank 104, the air drive system 100 may, for example, be easily connected to the water leaving the tank 104.

In some cases, the air drive system 100 may be installed in a tank 104 of an existing toilet 102 (e.g. as part of a retrofit). A toilet tank 104 may have a significant interior volume to accommodate the air drive system 100. In some other cases, the air drive system 100 may be disposed adjacent to or in the proximity of the toilet 102, outside of the tank 104. For example, the air drive system 100 may be disposed behind the toilet 102 or underneath the tank 104. A cover may conceal the external air drive system 100.

Figure 1B:
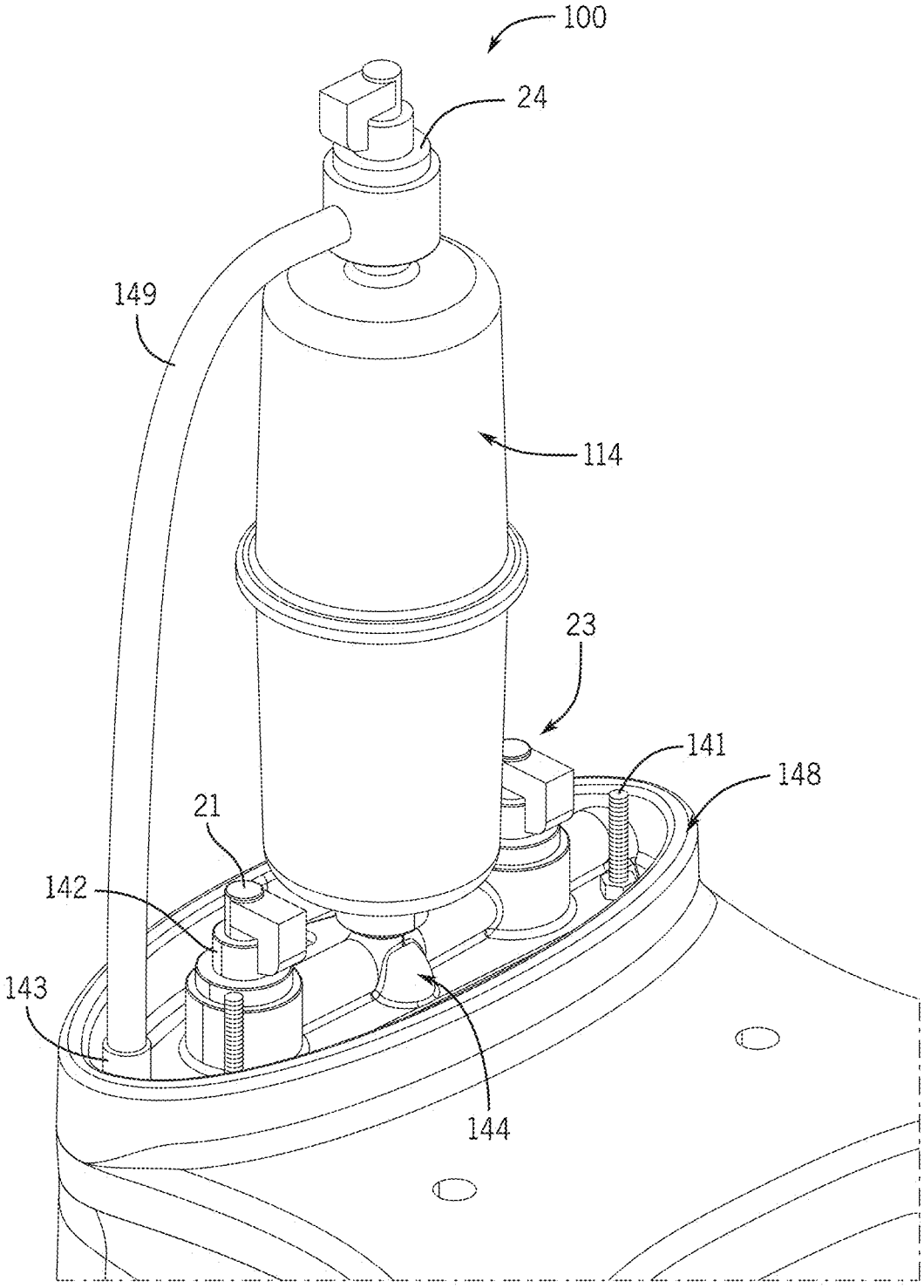
FIG. 1B illustrates the air drive system of FIG. 1A.

Such an installation example is shown in the air drive system 100 of FIG. 1B. The air drive system 100 is attached (e.g., through a base plate 148) to provide at least air and water to the toilet 102. In the embodiment shown, an array of valves selectively control the flow of water and air through a single cannister 114 of the air drive system 100. For example, a water inlet valve 21 (shown in FIG. 4, for example) controls the flow of water from water inlet 11 into the cannister 114 of the air drive system 100 through a water inlet pipe or hose 142. The water inlet 11 may be line pressure water. The water inlet 11 may be connected to a tank, for example, at a height greater than that of the air drive system 100 that provides potential energy to the pressure of the water at the water inlet 11. The water inlet 11 may connect to the plumbing system or a tank as an external device or the water inlet 11 may connected to a tank that encloses the air drive system 100 as shown by FIG. 1.

A water output valve 22 (shown in FIG. 4, for example) may control the flow of water out of the cannister 114 of the air drive system 100 via the water outlet pipe or hose 144. The water output valve 22 may connect to one or more rim apertures of the toilet 102. The rim apertures may be connected to one or more chambers within the toilet 102, as described in other embodiments. For examples, a curved chamber may be formed along the rim of the toilet to create a space for water the travel to multiple apertures around the rim. Water through the apertures provides rinsing and cleaning for the sides of the bowl. Water through the apertures provides a volume of water to fill the sump 109 and/or trapway of the bowl and create a seal for the siphon.

An air outlet valve 23 may control the flow of air out of the cannister 114 of the air drive system 100 through the air outlet through an air passage 141 (e.g., pipe, tubing, hose, or cavity). When the air outlet valve 23 is opened, air flows out of the air drive system 100 and through the air passage 141, which connects to the bowl via an air jet or air nozzle. The air passage is illustrated with various hoses but may be implemented in the toilet 102 through channels or chambers in the vitreous or China material that forms the toilet.

FIG. 1A illustrates an example sump 109 of the toilet 102. The sump 109 is the bottom portion of the toilet bowl. An air nozzle or sump jet 107 is connected to the sump 109. Air from the air outlet 13 from the air drive system 100 may be provided to the sump jet 107 to cause the toilet 102 to flush. The force of air from the air outlet 13 may push water that is in the sump 109 into the trapway.

A drain valve 24 may control the flow of water and/or air out of the cannister 114 of the air drive system 100 via the drain pipe or hose 149. The drain pipe 149 may be connected to a sewer or septic system drain via a flange or connector 143. The drain pipe 149 may alternatively be connected directly to the sump 109 of the toilet 102, for example with a one way valve to maintain the siphon seal. The drain pipe 149 may alternatively be connected a greywater system. That is, the excess water from the cannister 114 may be provided to a greywater tank where the water is stored for another use. The water may be recycled back to the toilet 102 or provided to a shower, sink, irrigation system or another device.

Figure 2:
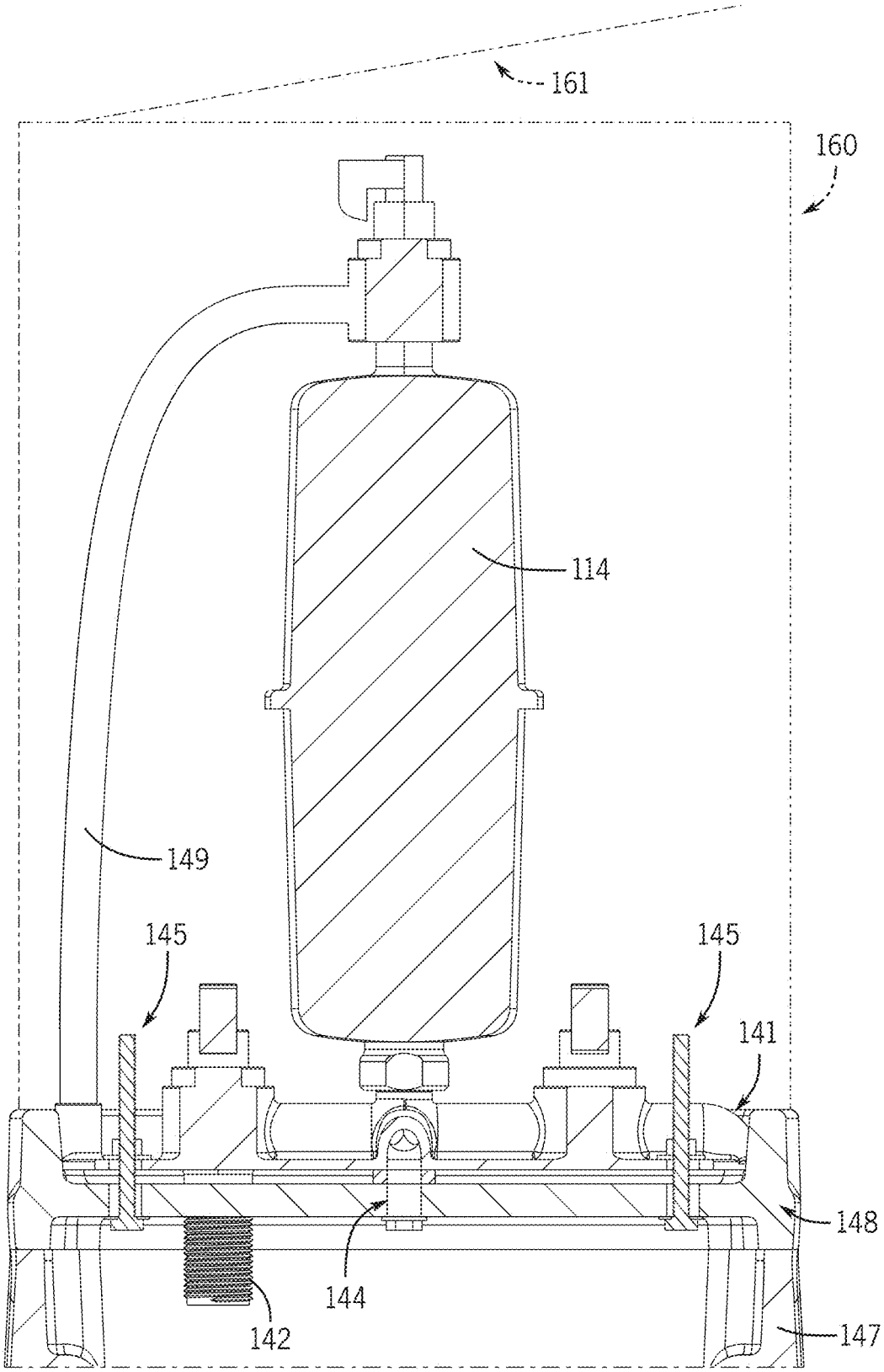
FIG. 2 illustrates a side view of the air drive system coupled to the toilet.
Figure 3:
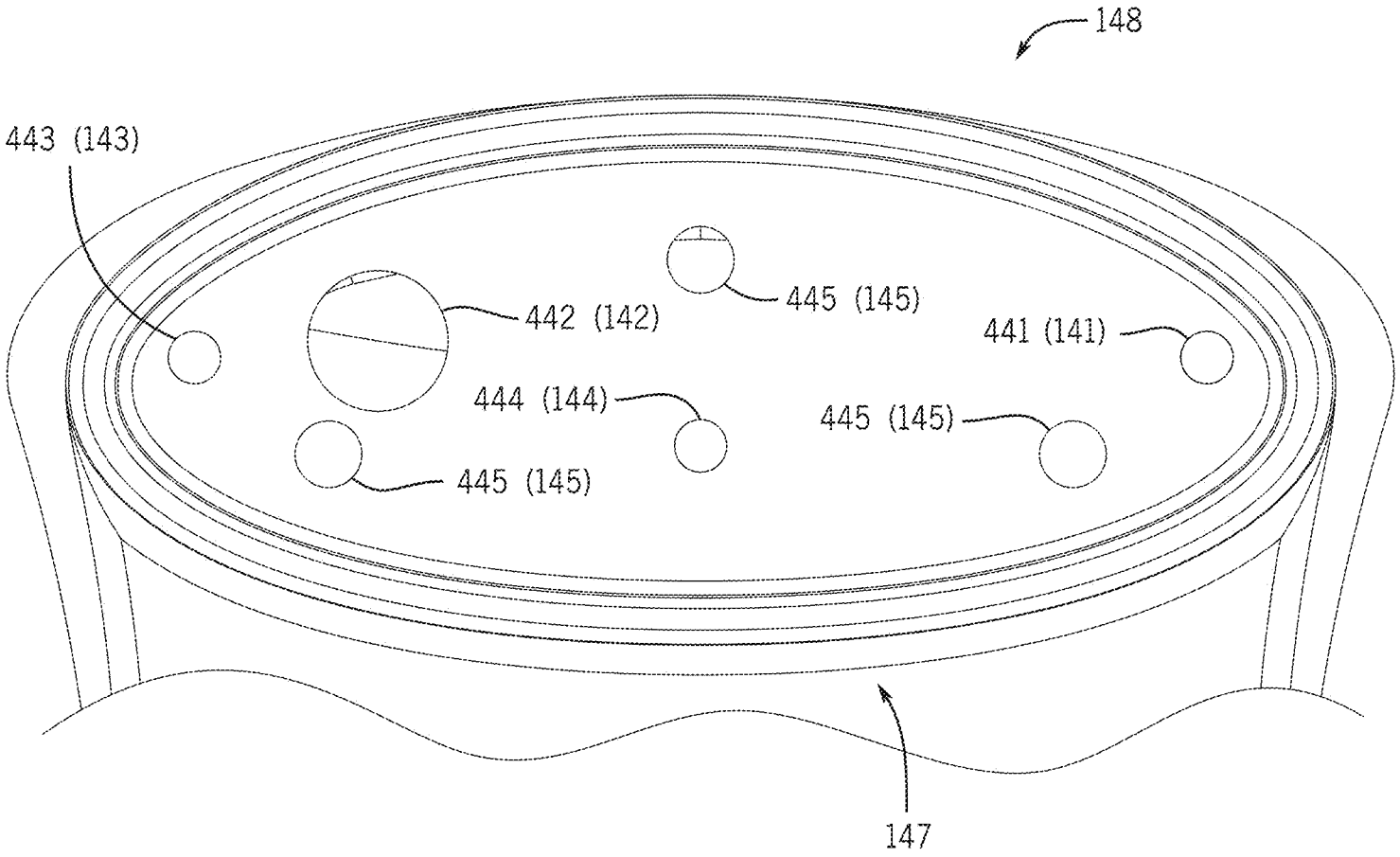
FIG. 3 illustrates a top view of the toilet with connections to the air drive system.

FIG. 2 illustrates a side view, and FIG. 3 illustrates a top view of the toilet 102 with connections to the air drive system 100. The air drive system 100 may be connected to the toilet 102 with one or more of a base plate 148, a fastener 145, and/or a pedestal arm. Additional, different, or fewer components may be included.

The base plate 148 may be formed from vitreous material and integrated with the toilet 102. The base plate 148 may be a separate component formed from plastic or another material to connect the toilet 102 to the air drive system 100. One or more fasteners 145 are configured to connect the base plate 148 to the air drive system 100. The fasteners 145 may include bolts and nuts that tighten over the bolt to hold the air drive system 100 to the base plate 148. The bolts and/or nuts may be formed from plastic. Two or three fasteners 145 may be used. Three fasteners 145 may be arranged in a triangular shape, as shown in FIG. 3.

The toilet 102 may include one or more legs 147 that extend from the pedestal of the toilet 102 to the base plate 148. A housing or frame 160 may surround the cannister 114 and the valve arrays. The housing may include a door 161 so that the air drive system 100 can be accessed by a user or technician. The door 161 may be opened to manually open or close any of the valves. The door 161 may be opened to replace or repair any of the components.

The base plate 148 includes multiple openings, as illustrated in FIG. 3, for connections between the toilet 102 and the air drive system 100. An opening 441 corresponds to the air passage 141. An opening 442 corresponds to the water inlet 142. An opening 443 corresponds to the drain 143. An opening 444 corresponds to the water outlet 144. One to three openings 445 correspond to the fasteners 145. Addition or different openings may be used.

Figure 4:
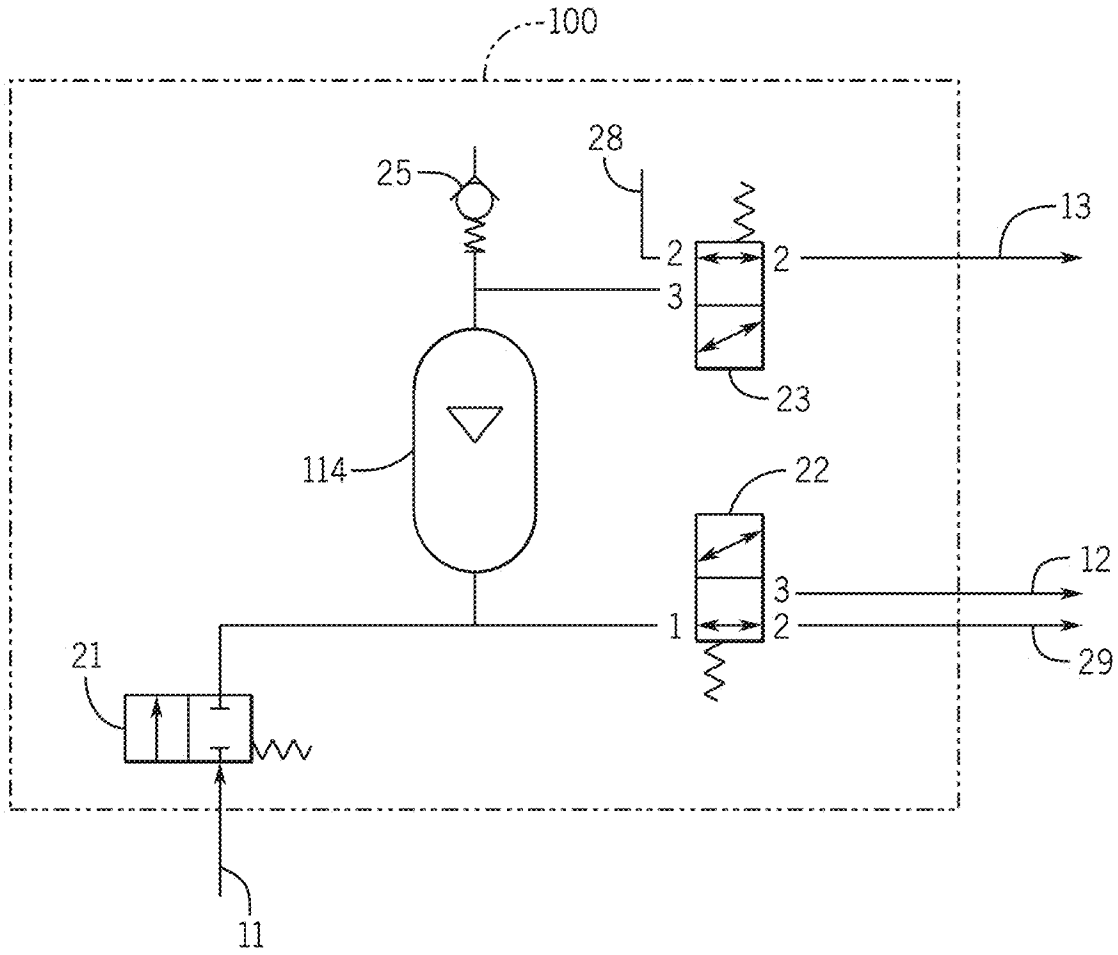
FIG. 4 illustrates a valve array for the air drive system.
Figure 5:
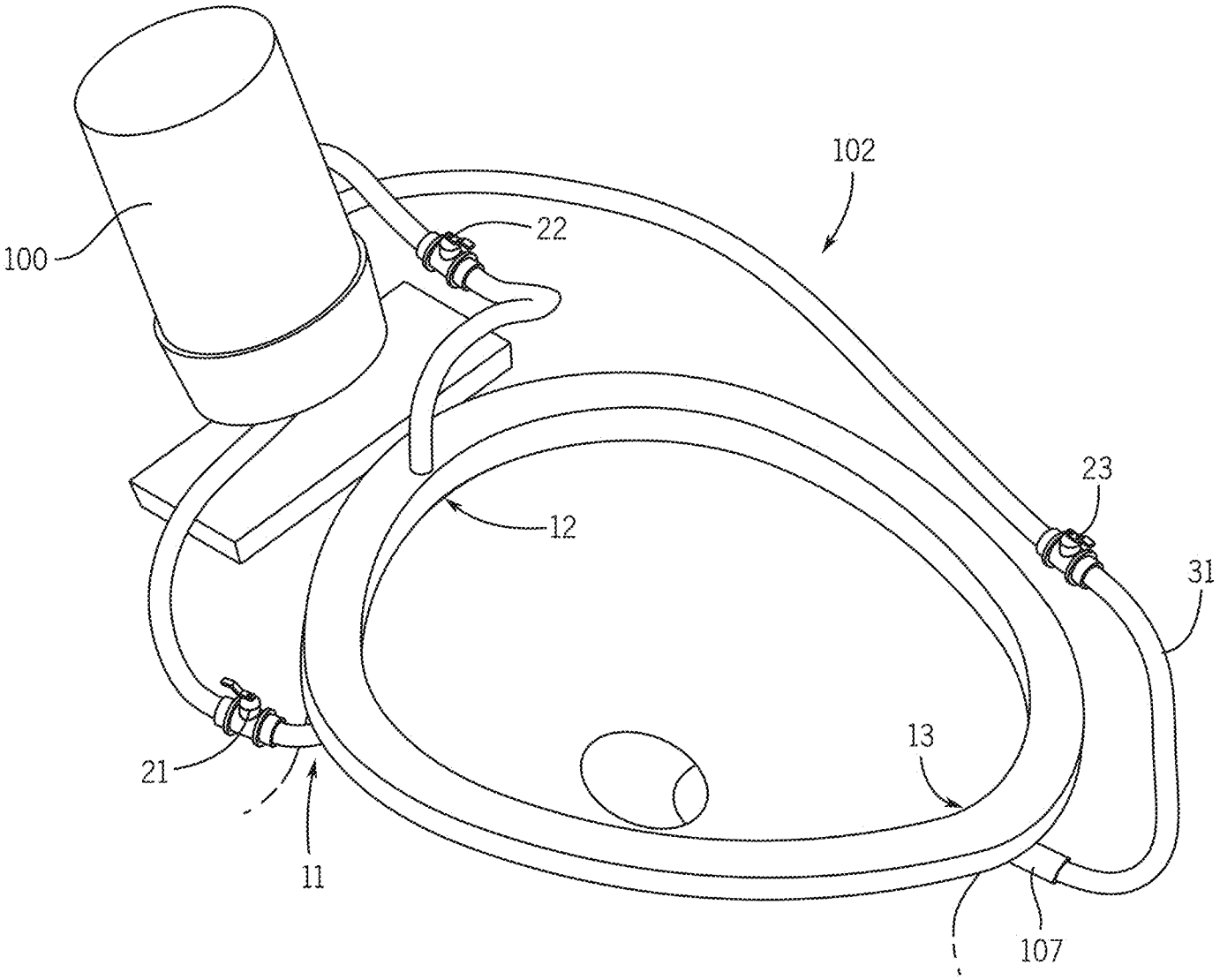
FIG. 5 illustrates an example embodiment for the valve array.

FIG. 4 illustrates schematic view for the valve array and the air drive system 100. FIG. 5 illustrates an example embodiment for the valve array using external hoses. Other embodiments utilize channels or passages contained with the toilet 102 or integrated with the vitreous material of the toilet 102.

The valve array may include water inlet valve 21, water output valve 22, and the air outlet valve 23. Optionally, a drain valve (combined air and water venting) may be attached to the air drive system 100 as part of the valve array, which may be alternatively implements as an individual air vent 28 and water drain 29. The valve array may be located inside or outside of the cannister 114 (pressure tank). That is, the housing of the cannister 114 may enclose the water inlet valve 21, the water output valve 22, and the air outlet valve 23.

The water inlet valve 21 may connect and disconnect the air drive system 100 to the plumbing system of a building as the water inlet 11. The water output valve 22 may connect and disconnect the air drive system 100 to the water outlet 12 at the bowl of the toilet 102. The water outlet 12 may include at least one opening at the rim of the toilet. There may be multiple openings for water outlet 12, which may be connected by a chamber, or connected by multiple tubes or channels. The water outlet 12 may be additionally or alternately located away from the rim. For example, the water outlet 12 may be located at the sump 109 or trapway of the toilet.

The air outlet 13 is coupled to the toilet 102. The air outlet 13 may provide air to the toilet bowl, for example at the sump 109. The sump 109 may be defined as the bottom portion of the bowl. The sump 109 may be the portion of the bowl that holds water when the siphon seal has been established. The sump may be a lower fraction (e.g., ¼, ⅛, or another portion) of the bowl.

Figure 6:
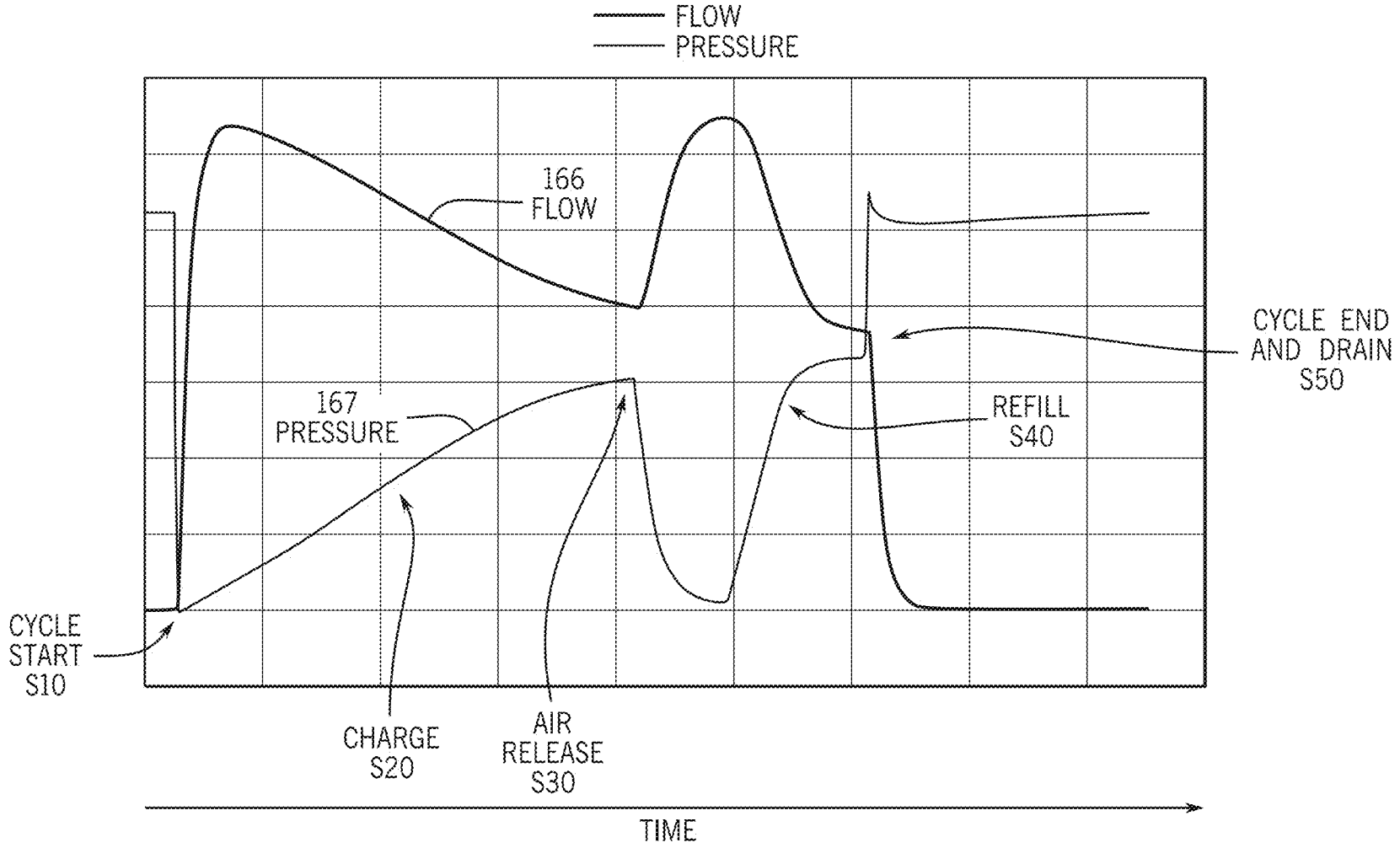
FIG. 6 illustrates an example graph for the flush cycle of the air drive system.

FIG. 6 illustrates an example graph for the flush cycle of the air drive system 100. The graph includes a flow 166 (e.g., air flow or air and water flow) and a pressure 167. The flow 166 may be a volume per unit time leaving the air drive system 100. The flow 166 may be the volume per unit time leaving the cylinder 115. The pressure 167 may be a pressure level in the air drive system 100 (e.g., measured inside the cylinder 114). The flush cycle may be represented with repeating stages represented by five events: a cycle start event S10, a charging event S20, an air release event S30, a refill event S40, and a cycle end and drain event S50. Additional, different, or fewer events or stages may be used.

At the cycle start event S10, the flush cycle is initiated. The start event S10 may be the opening of the valve 21. The flush cycle may be started through a user input (e.g., a button, a flush handle) on the toilet 102. Alternatively, the cycle start event S10 is started automatically (e.g., in response to a previous cycle or in response to the installation of the toilet 102), and the user input triggers the release stage S30, as described below.

Figure 22:
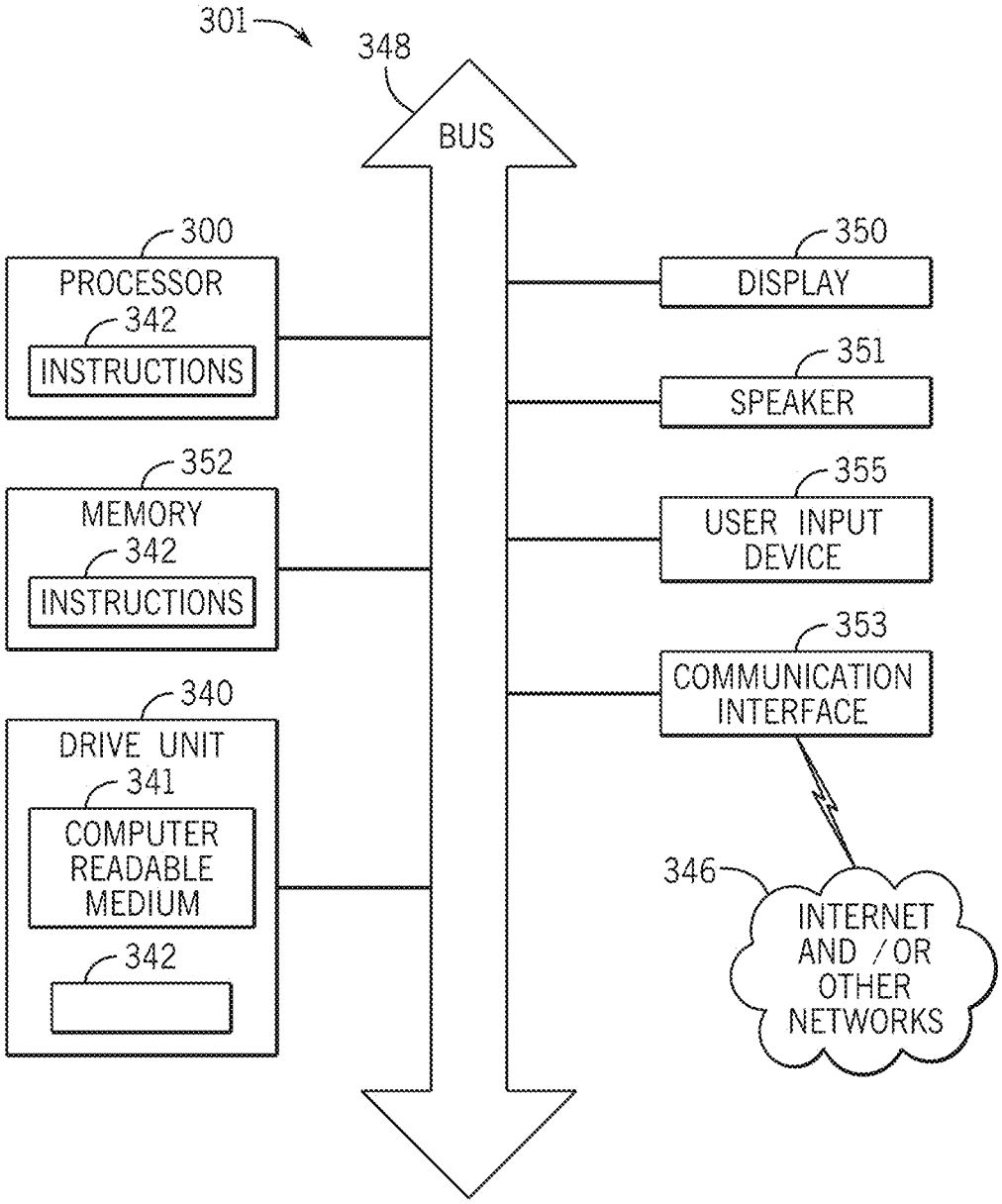
FIG. 22 illustrates an example an example controller for an air drive system.

The flush cycle may be initiated by a sensor and/or a controller (e.g. the controller 301 described with respect to FIG. 22). The sensor may detect a user or a gesture made by the user. In some examples, the sensor may include any type of sensor configured to detect certain actions and/or to provide functionality (e.g., dispensing, flushing, etc.). The sensor may include any type of sensor configured to detect certain conditions and/or to provide functionality. For example, the sensor may be configured to detect a water level in the bowl or a blockage in the trap. Odor sensors, proximity sensors, and motion sensors are non-limiting examples of sensors that may be employed with the systems of this application. Odor sensors, such as volatile organic compound (VOC) sensors, may be employed to detect organic chemicals and compounds, both human made and naturally occurring chemicals/compounds. Proximity sensors may be employed to detect the presence of an object within a zone of detection without physical contact between the object and the sensor. Electric potential sensors, capacitance sensors, projected capacitance sensors, and infrared sensors (e.g., projected infrared sensors, passive infrared sensors) are non-limiting examples of proximity sensors that may be employed with the systems of this application. Motion sensors may be employed to detect motion (e.g., a change in position of an object relative to the objects surroundings). Electric potential sensors, optic sensors, radio-frequency (RF) sensors, sound sensors, magnetic sensors (e.g., magnetometers), vibration sensors, and infrared sensors (e.g., projected infrared sensors, passive infrared sensors) are non-limiting examples of motion sensors that may be employed with the systems of this application. In another example, the sensor may include a light detection and ranging (LiDAR) that servers as a proximity sensor. The controller 301 receives sensor data and analyzes the sensor data to determine when a user is approaching or has approached the toilet 102. In another example, the sensor may include a sensor configured to detect a water level. The sensor may include a float sensor, a pressure level sensor, an ultrasonic water level transmitter, a capacitance level sensor (e.g., an RF sensor), and a radar level sensor. Further, an optical sensor may be used to determine a water level.

At the charging event S20, air pressure is built up in the air drive system 100 (e.g., within the cylinder 114). During the charging event S20, the valve 21 is open so that water from the water inlet 11 is allowed to enter the air drive system 100. During the charging event S20, a flow of water is supplied to a base opening of the compression cylinder 114. The flow of water increases air pressure in an air space of the compression cylinder 114. As shown by the graph of pressure 167, the pressure in the cylinder 114 slowly rises after the cycle start event SW (during the charging event S20) and the flow 166 increases rapidly then slowly decreases as pressure builds.

In some examples, during the charging event S20, the valve 22 is also opened. When the valve 22 is opened, water flows are provided to the bowl during the charging event S20. In other examples, water flows are provided to the bowl after the charging event S20 (e.g., or at a later portion of the charging event after the air pressure has charged or reached a predetermined level). The water flows may be provided to one or more rim apertures or jets which rinses or wash the side of the bowl and/or fill the sump of the bowl.

During the charging event S20, the air pressure that accumulates in the cylinder 114 may be regulated using a variety of techniques. In one example, an automatic pressure valve is used for the air vent 28. When the pressure in the cylinder 114 is below a predetermined pressure, the air vent 28 is closed. When the pressure in the cylinder 114 exceeds the predetermined pressure, the air vent 28 opens to release excess pressure. In other words, the automatic pressure valve maintains a maximum air pressure in the cylinder 114.

In another example, the air pressure in the cylinder 114 is regulated automatically by the line pressure of the water inlet 21. In other words, when the valve 21 is opened to allow water to enter the cylinder 114, a certain amount of pressure can accumulate in the cylinder 114 before in balances or reaches equilibrium with the line pressure.

In another example, a controller (e.g. the controller 301 described with respect to FIG. 22) controls the pressure in the cylinder 114. The controller may generate commands to open or close a valve, such as the air vent 28 or water inlet valve 21, in order to regulate the pressure in the cylinder 114. The controller may regulate the pressure in the cylinder 114 by periodically opening the air vent on a predetermined time interval. The controller may regulate the pressure in the cylinder 114 by opening the water inlet valve 21 only for a predetermined time period. In addition or in the alternative, a pressure sensor in the cylinder 114 may detect the pressure. In response to the detected pressure, the controller may open the air vent 28 when a predetermined pressure is exceeded. In response to the detected pressure, the controller may close the water inlet valve 21 when a predetermined pressure is exceeded.

At the air release event S30, the air outlet valve 23 is opened to provide air through the air outlet orifice 13. The air outlet valve 23 may be held open for a predetermined amount of time or until the pressure in the cylinder 114 lowers below a minimum value. As shown by the graph of pressure 167, the pressure in the cylinder 114 immediately decreases after the air release event S30 and the flow 166 begins to increase again as the pressure is lower inside the cylinder 114.

Through the opened outlet orifice 13 adjoining the air space of the cylinder 114, the flow of air travels through an air drive passage to an air driven device associated with the toilet 102. The air driven device may be a sump jet for flushing the toilet 102. The sump jet may be configured to apply a force of water to the sump of the toilet 102 to break a siphon seal in the trapway of the toilet 102 or otherwise cause the toilet to flush or the contents of the bowl to be evacuated. The air release event S30 to open the air outlet 13 may be mechanically triggered in response to a user input (e.g., a button, a flush handle). The air release event S30 may be triggered by the controller in response to sensor data or an electronic flush initiated by the user.

At the refill event S40, a similar process may repeat to return the cylinder 114 to high air pressure. The duration for the refill may be less than the initial charge depending on how low the water level in the cylinder 114 falls during the discharge of air.

When the toilet 102 is taken offline or when a system reset is performed, the cycle end and drain event S50 returns the air drive system 100 to the initial state before the cycle start event S10. The drain 29 may be opened to empty the cylinder 114, draining out the water until the cylinder 114 is empty. In some examples the valve 22 may include two valves: a bowl water valve and a drain valve. The bowl water valve allows the water to flow to the bowl. The drain valve may be opened at the end of the flush cycle.

Figure 7A:
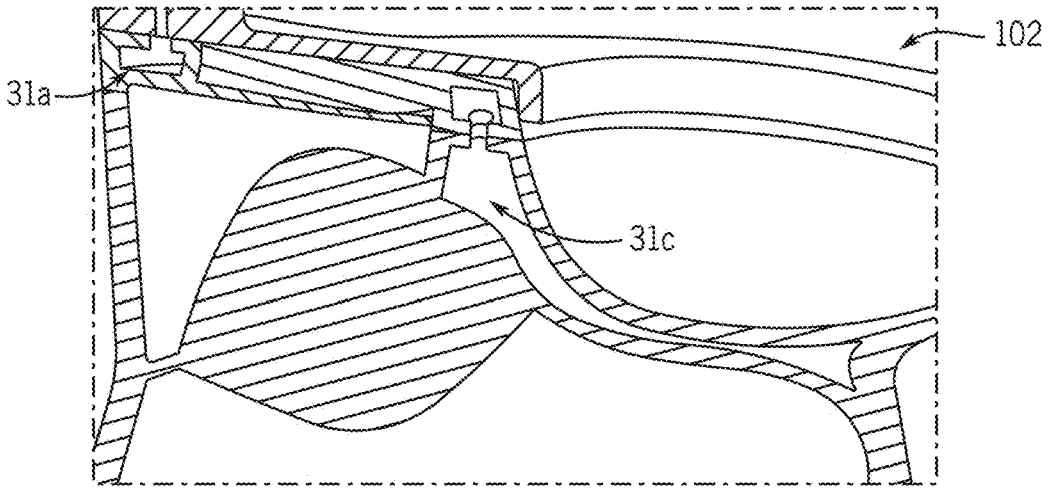
FIGS. 7A-C illustrate example passages for the air drive system.
Figure 7B:
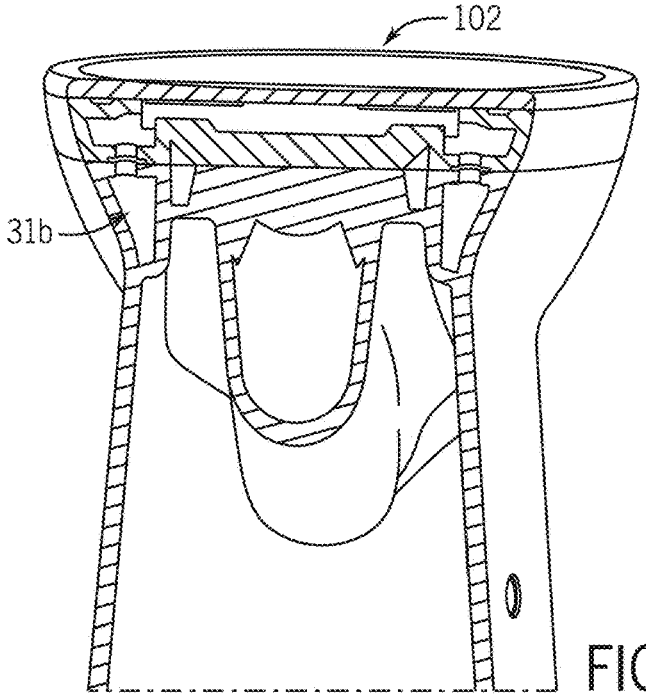
Figure 7C:
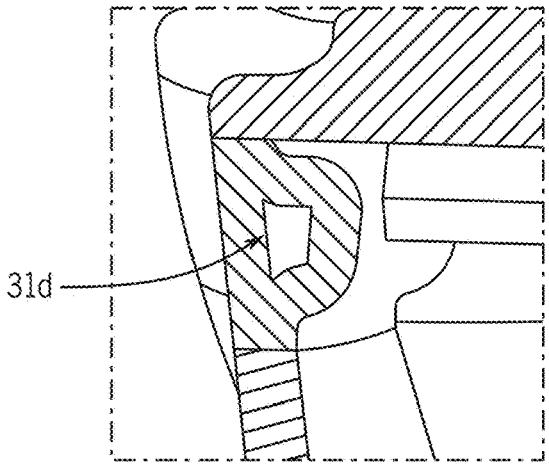

FIGS. 7A-C illustrate an example set of pathways for the air passage 31. The air outlet 13 provides the pressurized air to a distribution channel 31*a* below the air drive system 100. The distribution channel 31*a* may extend in at least one direction perpendicular to the air outlet 13. A transverse chamber 31*c* provides an air path under or around the bowl of the toilet 102. A metering aperture 31*b* connects the distribution channel 31*a* to the transverse chamber 31*c*. The transverse chamber 31*c* provides the air to the jetway 108 and into the front of the toilet 102. The air may be a pulse of air (e.g., air flow that starts and stops within a predetermined range of time) to provide a force to the water in the sump 109 of the toilet 102. The force may prime the siphon or break the siphon, depending on when the air is pulsed during the flush cycle. The force from the air pulse may also directly evacuate contents from the bowl to the drain.

In one example, as shown in FIG. 3C, a connection channel 31*d*, connects multiple distribution channels 31*a* to the transverse chamber 31*c* and/or connects the distribution channel 31*a* to the air drive system 100 through the vitreous material.

Figure 8:
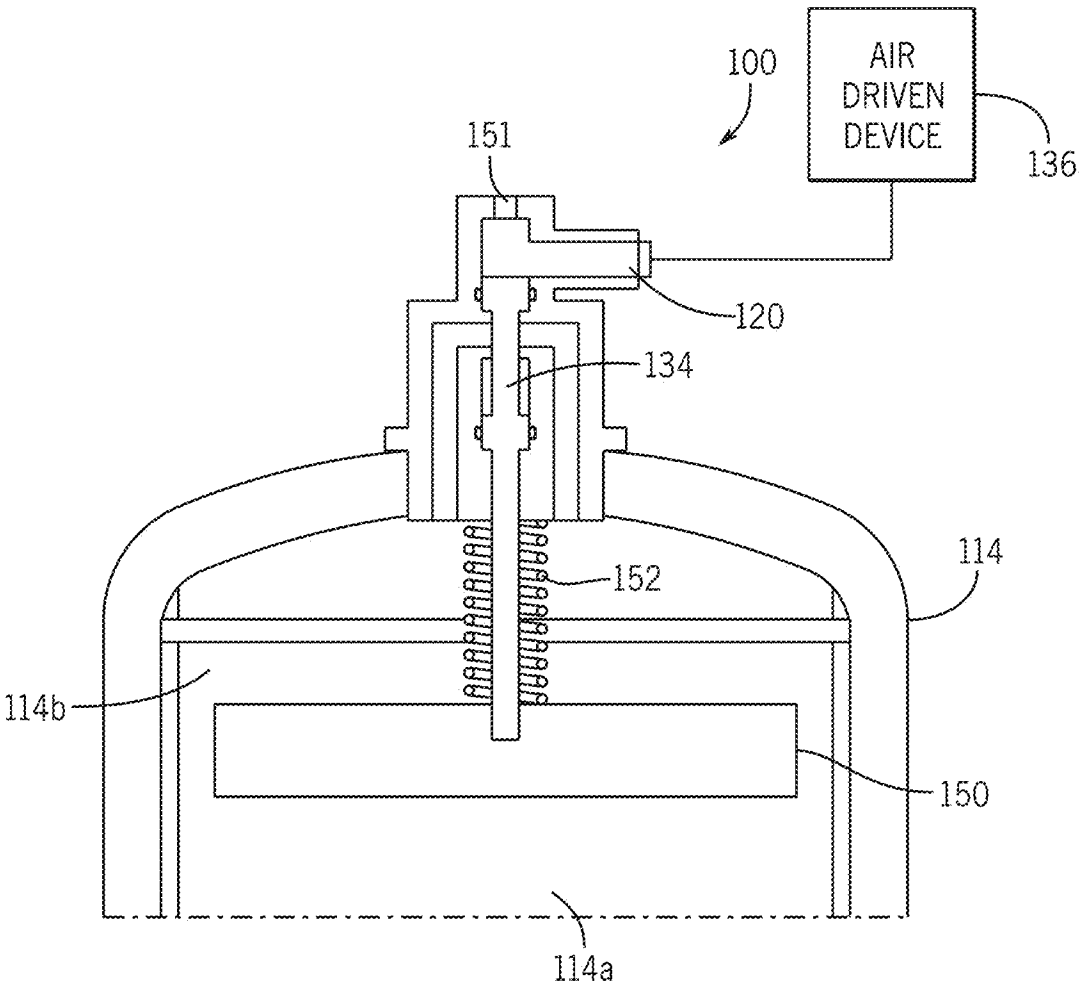
FIG. 8 illustrates an embodiment of an air drive system for a toilet.

FIG. 8 illustrates an example float 150 that actuates the piston 134 for the air drive system 100. The piston 134 may operate as a valve. The float 150 may be disposed in a compression cylinder 114 and/or a timing cylinder 122, but only the compression cylinder 114 is included in the embodiment of FIG. 8. As the volume of water in the cylinder 114 increases, the float 150 rises in response. Movement of the float 150 moves the piston 134 and releases pressurized air from the cylinder 114 through the air drive passage 120. The position of the float 150 and/or the piston 134 may be biased by a spring 152. The spring 152 may bias the piston toward a closed position (e.g. sealing the cylinder 114 from the air drive passage 120) or resist the force of the water in the cylinder 114 acting against the float 150. The air drive system 100 may include a vent 151 for venting remaining pressurized air in the air drive passage 120 when the piston 134 is in a retracted position. As an alternative to the float 150, a diaphragm may separate the water space from the air space. The diaphragm may be coupled to the piston 134.

The cylinder 114 may have a cylindrical shape but may be a chamber having a variety of shapes such as a rectangular prism, a triangular prism, or another shape. The chamber may be effectively divided by the float 150 to form a fluid space 114*a* and an air space 114*b*. The float 150 is positioned between the fluid space 114*a* and the air space 114*b* in the chamber. The float 150 moves in response to the increase in the fluid space 114*b* in the chamber. When the fluid space 114*a* increases, the float 150 is move up to actuate the piston 134 (a valve) to supply air from the air space 114*b* of the chamber to an air drive passage 120 and the air driven device 136.

Water, or another liquid is provided to the fluid space 114*a* through a water supply. For example, the water supply may be a tank, a pressured water container, or a utility supply of water. As detailed in other embodiments, the fluid space 114*a* may be connected to a base orifice that adjoins the fluid space 114*a*. The base orifice, or other water inlet, of the cylinder 114 is in fluid communication with the air space 114*a*. That is, as water flows into the cylinder 114, the air space 114*a* is compressed.

As water flows into the fluid space 114*a*, for example through the base orifice, the water level rises (water volume increases) in the cylinder 114 and presses the float 150 upward. A force is applied from the water in the fluid space 114*a* to the float 150 that moves the float 150. As the fluid space 114*a* increases in volume, the air space 114*b* decreases in volume. Because the cylinder 114 is closed or otherwise sealed and no, or substantially no, air is escaping, the air in the air space 114*b* increases in pressure.

When the piston 134 or other valve is opened, the air pressure is released through the air drive passage 120 to supply pressurized air from the chamber to a toilet. For example, an air driven device 136 may be associated with the toilet 102.

In some examples, the air drive passage 120 may include a vent in fluid communication with the air drive passage 120 configured to release the pressurized air from the air drive passage 120. The vent may allow excess air pressure that builds up to escape. Thus, the air vent may be an escape valve that opens at a predetermined pressure. The air vent may be a duckbill valve.

Figure 9:
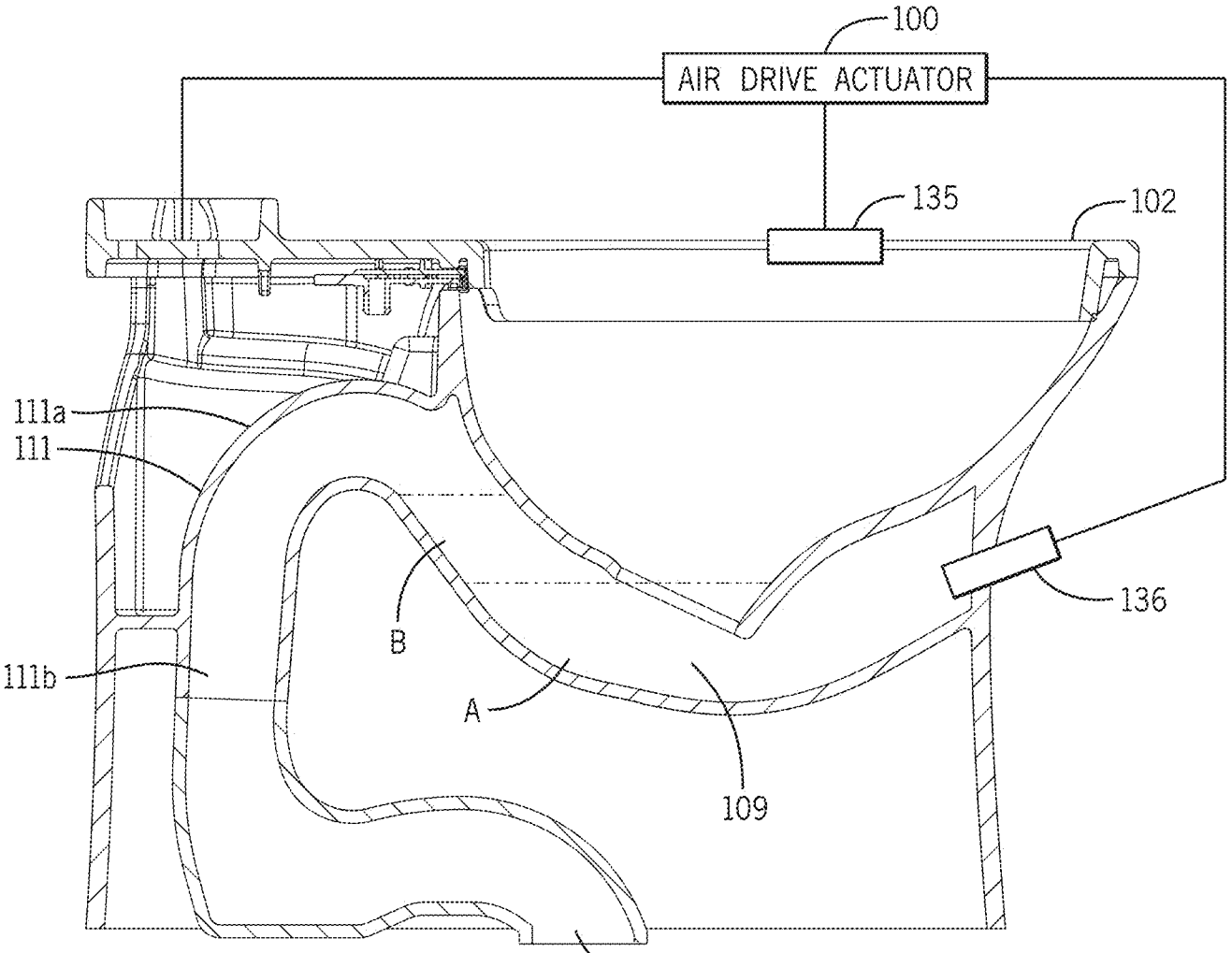
FIG. 9 illustrates the air drive system installed on the sump of the toilet.

FIG. 9 illustrates an example installation of the air driven device 136 at the front of the toilet 102. The air driven device 136 may be an air nozzle or a jet mounted at or otherwise positioned at the sump 109 of the toilet 102. The air nozzle 107 may be a siphoning jet in fluid communication with the air drive passage to provide the pressurized air to flush the toilet 102.

The sump 109 is the bottom portion of the toilet that includes the water used for flushing or evacuating the toilet. The water in the sump 109 may be considered a first volume of water (A). The sump 109 is connected to a trap or trapway 111 of the toilet 102, which is downstream of the sump. The trap is configured to store a second volume (B) of water providing a sanitary seal for the toilet.

The air driven device 136 through the air drive passage 120 is configured to supply pressurized air from the cylinder 114 to the first volume of water in the sump 109 to the trap. The first volume of water displaces the second volume of water to break the sanitary seal to flush the toilet 102. The water passage provides the first volume of water to the sump from the flow of water carried by the water passage.

As discussed above, a rim jet 135, for example including water outlet 12, is also in communication with the cylinder 114. The rim jet 135 is in fluid communication with the water passage and adjacent to the bowl. The water expelled from the rim jet 135 rinses the side of the toilet bowl. The water from the rim jet 135 falls to the bottom of the bowl, filling the sump 109. Thus, the water passage is configured to supply the first volume of water to the sump 109 through the rim jet 135.

The first volume of water (A) stored in the sump 109 is greater than the second volume of water (B) disposed in the trap 111. As shown in FIG. 9, the trap 111 may include multiple sections including a first pipe extending from the sump 109 to a top portion 111*a* and a second pipe 111*b* (vertical section) extending from the top portion to a drain or outlet pipe 111*c*. A space in the second pipe 111*b* section between the outlet pipe and 111*c* the top portion 111*a* defines the volume of the water seal.

Figure 10:
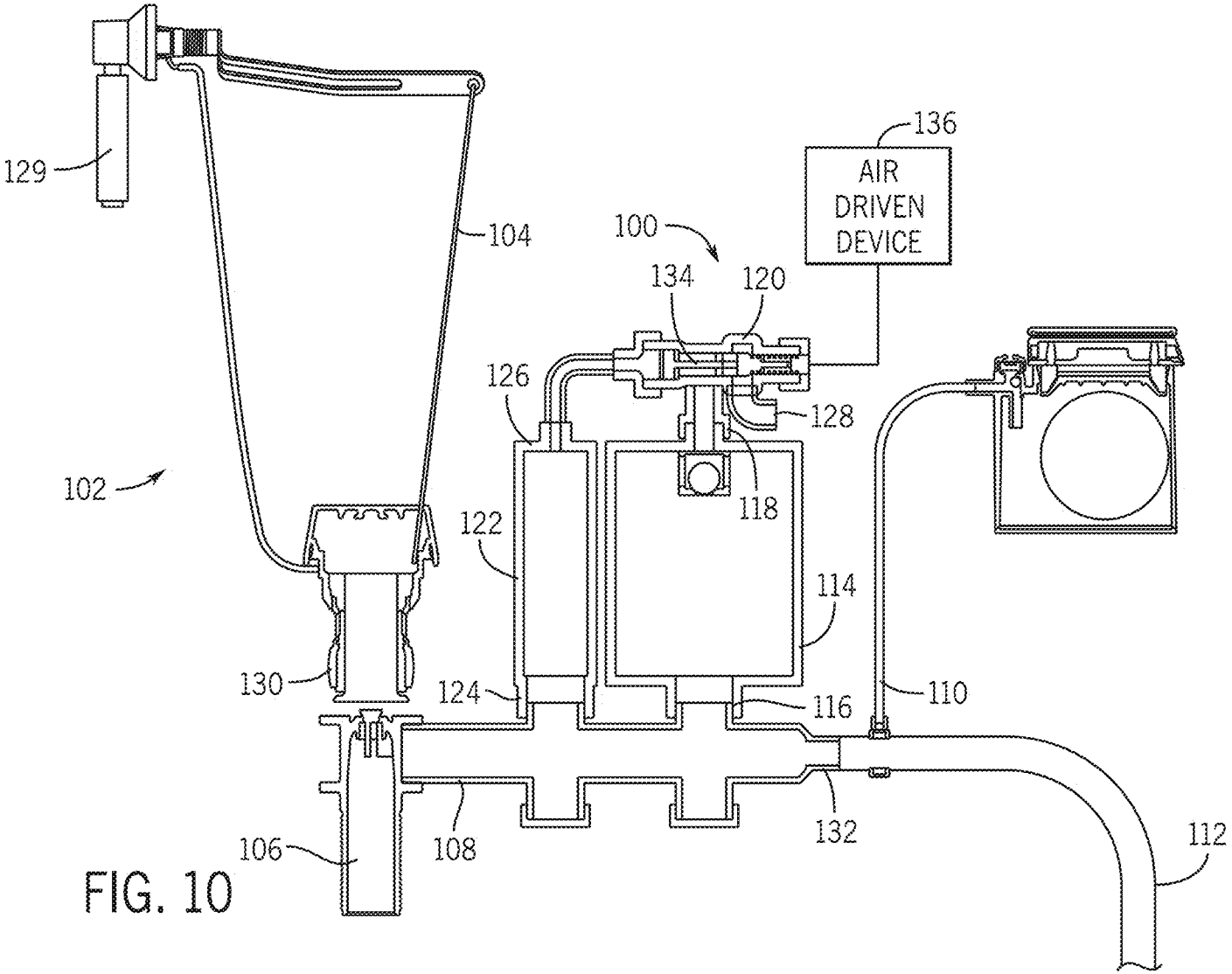
FIG. 10 illustrates another an air drive system for a toilet.

FIG. 10 illustrates an example air drive system 100. The system 100 may be installed, for example, in a toilet 102. Though an example of a toilet 102 is shown in FIG. 10, the air drive system 100 may be installed in or connected to other sanitary facilities, for example, a sink, a shower, a bathtub, or a jetted tub (e.g. a "whirlpool"). The toilet 102 may include a tank 104 in fluid communication with a water supply connection 106. The tank 104 fills with water from the connection 106. A jetway 108 may be in fluid communication with main fill valve 130, the tank 104, and the system 100. When the main fill valve 130 is opened, water may flow out of the tank 104 and through the jetway 108 to one or more of the system 100, an auxiliary pipe 110, and/or a bowl output 112. The auxiliary pipe 110 may provide water to one or more auxiliary devices, such as a cleaning solution dispenser. The bowl output 112 may provide water to a sump or siphon to assist in flushing the toilet 102. The tank 104 may be drained (e.g., by opening the main fill valve 130) using a handle 129 or other user input.

The system 100 may include a compression cylinder 114 with a base orifice 116 and an outlet orifice 118. Though the compression cylinder 114 is shown with a cylindrical shape, other shapes of the compression cylinder 114 may be used. The base orifice 116 may allow for water and/or air to enter the compression cylinder 114. For example, a mixture of water and air may flow from the tank 104 (e.g. in response to the toilet 102 being flushed) through the main fill valve 130. As the water passes the base orifice, e.g. though the jetway 108, the air and water may accumulate in the cylinder 114. In particular, the air may separate from the water and increase an air pressure in the cylinder 114. Accumulation of the water in the cylinder 114 may be increased by a narrow portion 132 (e.g., venturi) of the jetway 108. For example, when the narrow portion 132 is disposed downstream of the cylinder 114, water may accumulate in the cylinder 114 upstream of the narrow portion 132. That is, the narrow portion 132 or venturi may cause back pressure that fills the cylinder 114 and/or the timing cylinder 122.

The outlet orifice 118 may allow for air to leave the compression cylinder 114. For example, air may flow from the outlet orifice 118 to an air drive passage 120.

Air exiting the air drive passage 120 may drive one or more air driven devices 136, which may include one or more accessories or air jets. For example, the pressurized air in the air drive passage 120 may be released as part of flushing the toilet 102. The chamber may be connected to a siphon jet, which provides breaks the siphon in the trapway in order to suction wastewater from the bowl during the flush cycle. In another example, the air from the air drive passage 120 may drive an aerosolizer. The aerosolizer may use the pressurized air in combination with a disinfectant, such as hydrogen peroxide, to create a dry fog in a toilet bowl. In some cases, the aerosolizer may spray in between users, such as when the toilet bowl is refilling with water. Any of the examples described herein with accessories may be applied as an air driven device 136. The air jet for flushing the toilet 102 may be used in addition to or in the alternative to the other accessory examples in all embodiments.

In some cases, a fluid connection between the compression cylinder 114 and the air drive passage 120 may be regulated by a timing cylinder 122. In some other cases, the fluid connection between the cylinder 114 and the air drive passage may be regulated by a float. The timing cylinder 122 may include a timing base orifice 124 and a timing outlet orifice 126. The timing cylinder 122 may be an example of a fluid capacitor. In some cases, and as shown in FIG. 1, the timing cylinder 122 may be upstream of the compression cylinder 114. In some other cases, the timing cylinder 122 may be downstream of the compression cylinder 114. Though one timing cylinder 122 is shown in FIG. 10, multiple timing cylinders 114 may be present. The timing cylinders may be disposed upstream, downstream, or both upstream and downstream of the compression cylinder 114. Multiple timing cylinders 122 may be used to regulate the timing and activation of multiple functions in communication with the air drive passage 120.

When the toilet is flushed, e.g. by a user or automatically, water may flow from the main fill valve 130 into the jetway 108. As the water passes the base orifices 116, 124, water may begin to accumulate in the compression cylinder 114 and/or one or more timing cylinders 122. In some cases, the rate or amount of water that accumulates in the compression cylinder 114 may differ from the amount or rate of water that accumulates in one or more timing cylinders 122. For example, a compression cylinder 114 with a greater cross-sectional area or larger base orifice 116 may accumulate water more quickly or in greater amounts than a timing cylinder 122 with a smaller cross-sectional area or a smaller base orifice 124. Additionally or alternatively, the rate of water or amount of water accumulating in the compression cylinder 114 may be increased by disposing the cylinder 114 and base orifice 116 upstream of a timing cylinder 122.

As the water accumulates in the cylinders 114, 122, the air pressure in the cylinders 114, 122 may also increase. A piston 134 may be in fluid connection with the compression cylinder 114 and, in some cases, one or more timing cylinders 122. In a first position, the piston may block or restrict a connection between the compression cylinder 114 and the air drive passage 120. When the air pressure in the compression cylinder 114 and/or the timing cylinder(s) 122 reaches a threshold amount, the piston 134 may move from the first position to a second position, where the piston 134 no longer blocks a fluid connection between the compression cylinder 114 and/or the timing cylinder(s) 122 and the air drive passage 120. When the connection to the air drive passage 120 is opened by movement of the piston 134 into the second position, the pressurized air in the compression cylinder 114 and/or the timing cylinder(s) 122 may escape through the air drive passage 120 to actuate the functions connected to the air drive passage 120.

Though the building of pressure in the cylinders 114, 122 may begin when the toilet 102 is flushed, the actuation and timing of the piston 134 moving from the first position to the second position may depend on the size, shape, and design of the cylinders 114, 122, or on other factors. For example, a threshold air pressure at or beyond which the piston 134 may actuate may depend on a size or cross-sectional area of the timing cylinder 122, the timing base orifice 124, the compression cylinder 114, and/or the base orifice 116. In another example, the piston 134 may be biased to the first position or the second position by a spring. Varying the spring rate of the spring may increase or decrease the threshold air pressure for actuating the piston.

Subsequent to the release of the pressurized air in the compression cylinder 114 and/or the timing cylinder(s) 122, the piston 134 may return to the first position. When the piston 134 is in the first position, pressurized air may again accumulate in the compression cylinder 114 and/or the timing cylinder(s) 122 when the toilet 102 is flushed.

The air drive system 100 may include a conduit 128 leading from the air drive passage 120 to an accessory 136. When the piston 134 is actuated, the air drive passage 120 releases pressurized air from the air drive system 100 to the accessory 136 via the conduit 128.

Figure 11A:
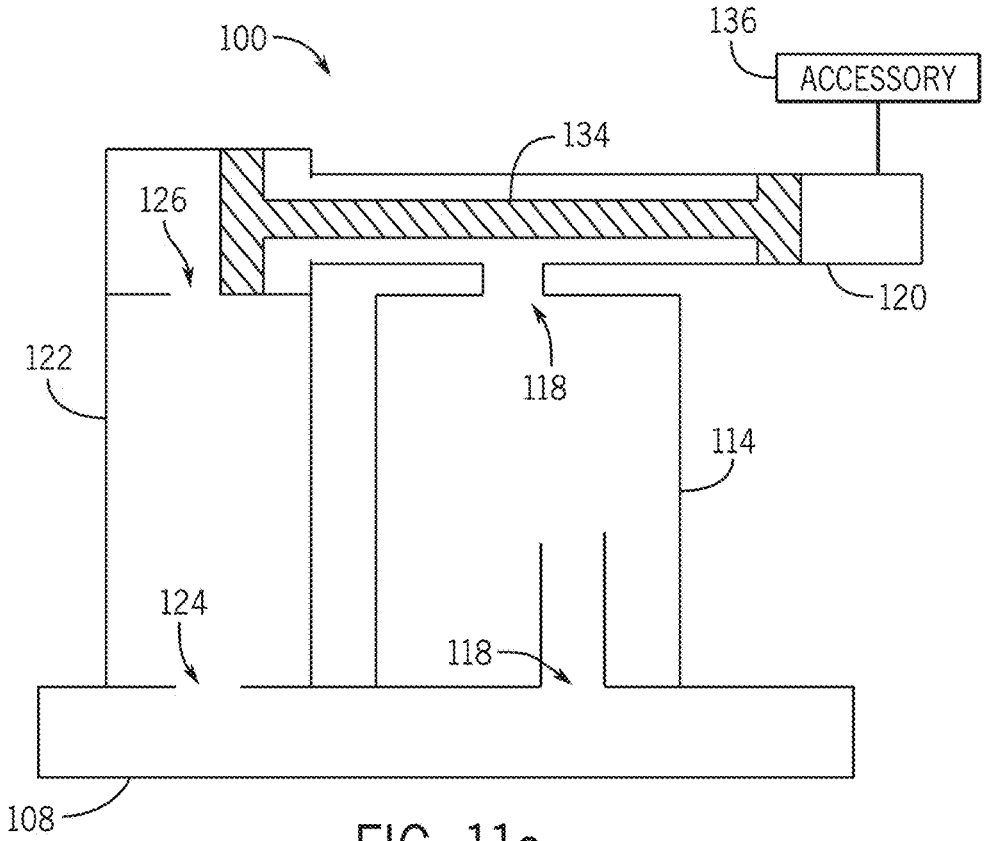
FIG. 11A illustrates another example air drive system for a toilet in a first position.
Figure 11B:
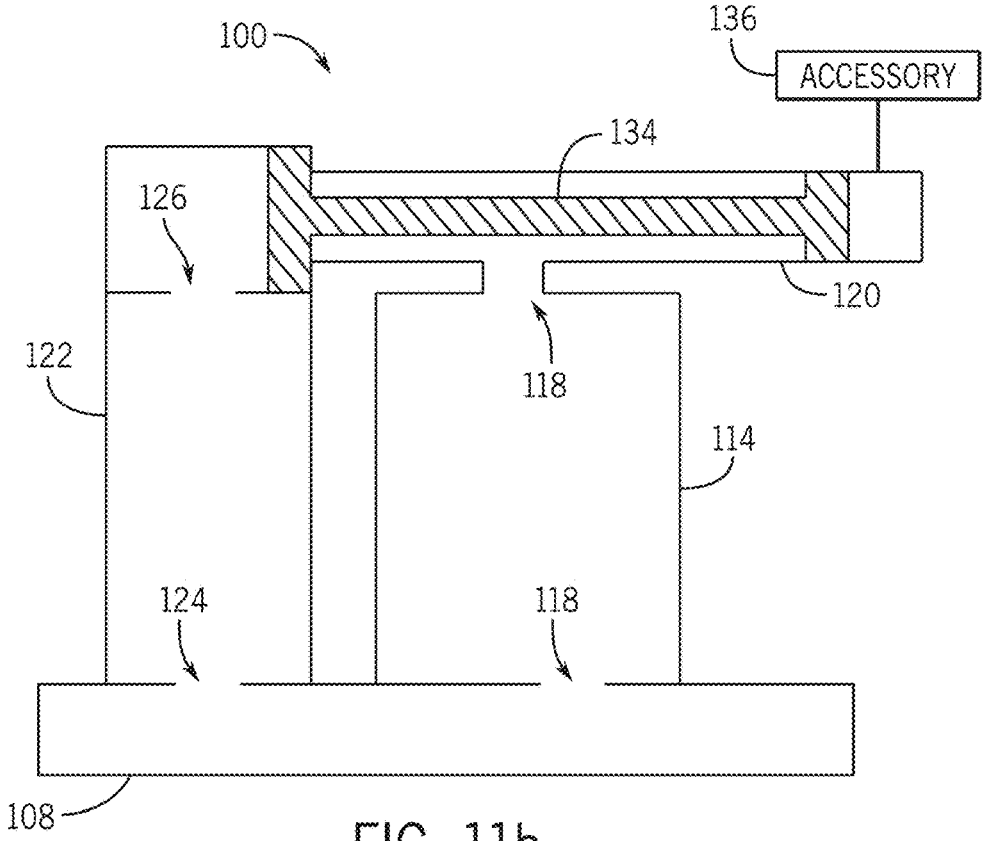
FIG. 11B illustrates another example air drive system for a toilet in a second position.

FIGS. 11A and 11B illustrate another example air drive system 100 for a toilet with a piston 134 in a first position and a second position, before and after actuation, respectively. The piston 134 starts in a position of FIG. 3*a* when there is no pressurized air in the timing cylinder 122, or when air pressure is building in the timing cylinder 122. In this position, an end of the piston 134 is blocking the passage of air to the accessory. In some cases, a spring may bias the piston 134 into this position.

As water passes by the timing cylinder 122 during a flush, air pressure builds in the timing cylinder 122 and the compression cylinder 114. However, based on different sizes, volumes, diameters, cross sections, and other geometry, the air pressure will build at different rates in the timing cylinder 122 and the compression cylinder 114. Once sufficient pressure has built up in the timing outlet orifice 126 in fluid communication with the timing cylinder 122, the piston 134 is pushed to the second position shown in FIG. 3*b*, where the air stored in the compression cylinder 114 may flow to the accessory. In this way, the timing cylinder 122 activates the piston 134 and controls the release of the air in the compression cylinder 114. Based on the operation of the timing cylinder 122, the operation of one or more accessories 136 may be controlled.

When the air is released from the compression cylinder 114 and the flush finishes, the piston 134 moves back to the rest position shown in FIG. 3A. For example, a spring may bias the piston 134 to the rest position. By returning to the rest position where air is prevented from passing to the accessory, air pressure may build again in the timing cylinder 122 and the compression cylinder 114 during the next flush.

Figure 12A:
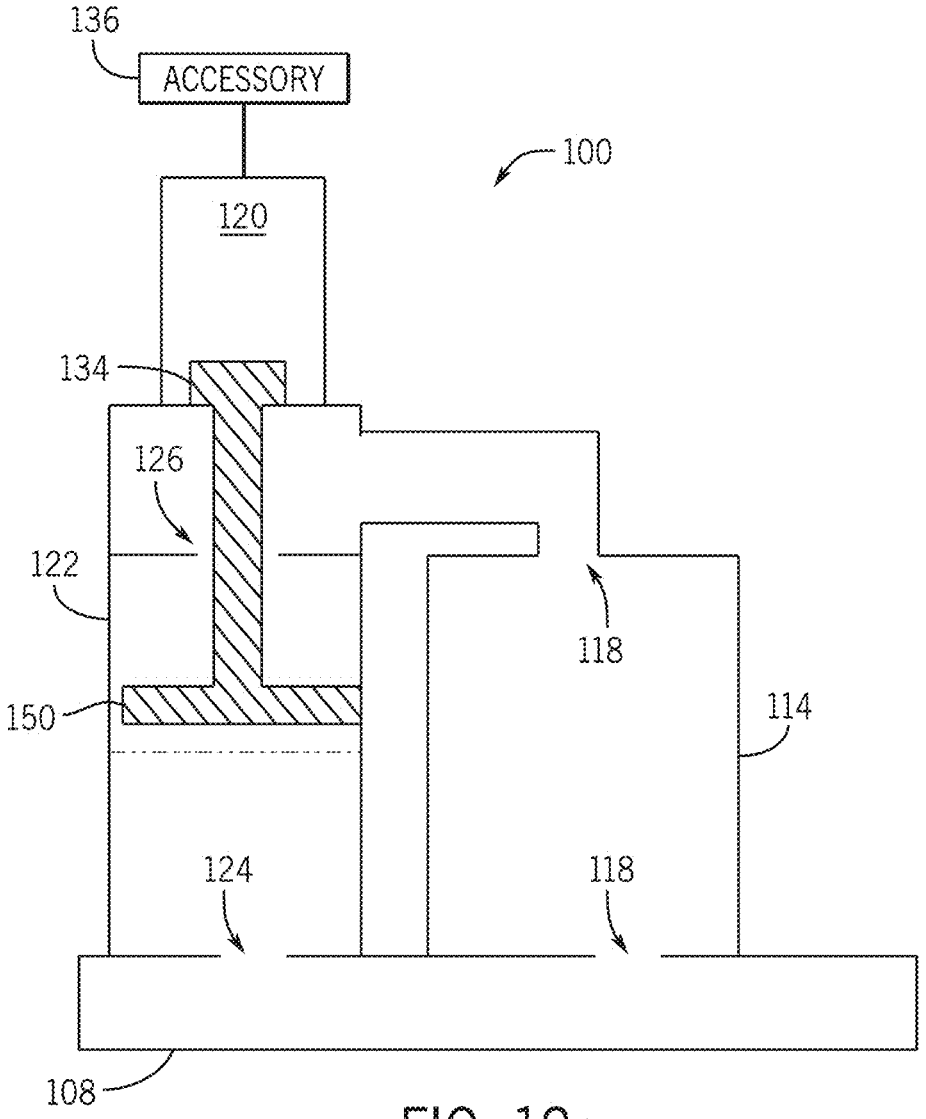
FIG. 12A illustrates a further example air drive system for a toilet in a first position.
Figure 12B:
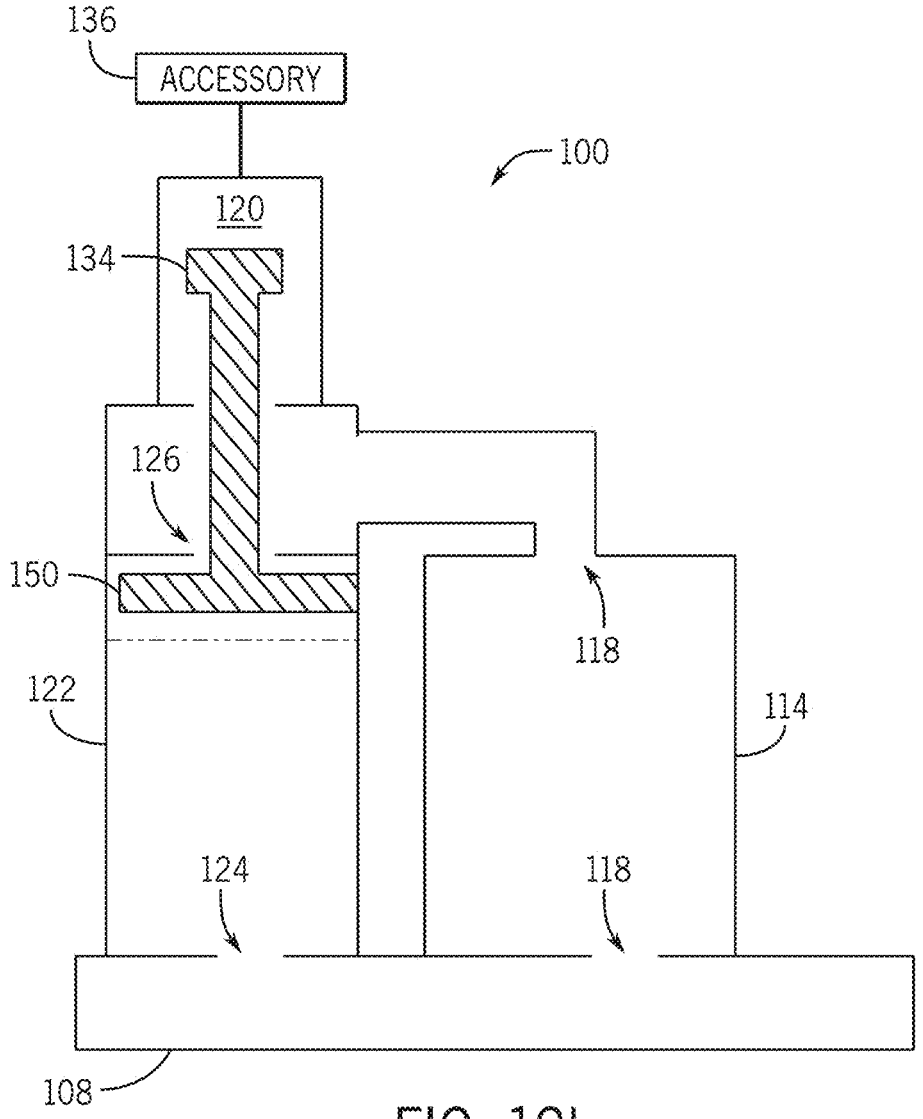
FIG. 12B illustrates a further example air drive system for a toilet in a second position

FIGS. 12A and 12B illustrate a further example air drive system 100 for a toilet with a piston 134 in a first position and a second position, before and after actuation, respectively. In this example, the timing cylinder 122 is configured with a float 150 (e.g. as described with respect to FIG. 8). The piston 134 starts in a position of FIG. 12A when there is no pressurized air in the timing cylinder 122, or when air pressure is building in the timing cylinder 122. In this position, an end of the piston 134 is blocking the passage of air to the accessory. In some cases, a spring may bias the piston 134 into this position.

As water passes by the timing cylinder 122 during a flush, air pressure builds in the compression cylinder 114, the volume of water in the timing cylinder 122 increases, and the float 150 rises. Based on different sizes, volumes, diameters, cross sections, and other geometry, the air pressure will build at different rates in the timing cylinder 122 and the compression cylinder 114. Once sufficient pressure has built up in the timing outlet orifice 126 in fluid communication with the timing cylinder 122, the piston 134 is pushed to the second position shown in FIG. 5B, where the pressurized air stored in the compression cylinder 114 may flow to the accessory. In this way, the timing cylinder 122 activates the piston 134 (e.g. by the action of the float) and controls the release of the pressurized air in the compression cylinder 114. Based on the operation of the timing cylinder 122, the operation of one or more accessories 136 may be controlled.

Figure 13:
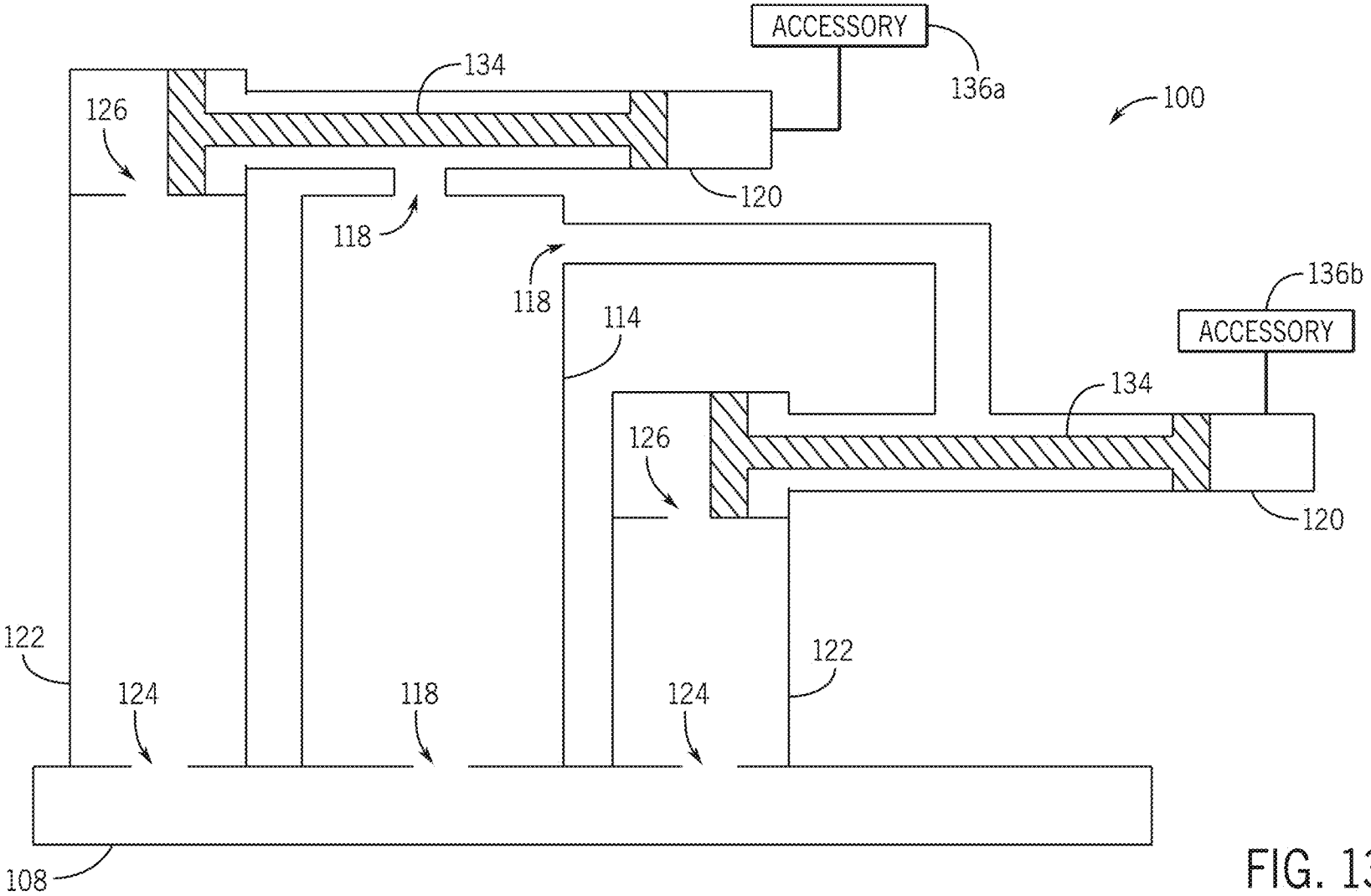
FIG. 13 illustrates yet another example air drive system for a toilet.

FIG. 13 illustrates yet another example air drive system 100 for a toilet including a compression cylinder 114, a jetway 108, and two air drive passages 120. In this example, two timing cylinders 122 are in fluid communication with a compression cylinder. The dual timing cylinders 122 control the release of the pressurized air in the compression cylinder 114 to two or more accessories 136*a*, 136*b*. For example, the timing cylinders 122 may be dimensioned to actuate a respective piston 134 at different times. A first timing cylinder 122 may actuate a first piston at a first time to release pressurized air from the compression cylinder 114 to a first accessory, and a second timing cylinder 122 may actuate a second piston 134 at a second time, after the first time, to release pressurized air to a second accessory 136*b*. In some cases, the first timing cylinder 122 and the second timing cylinder 122 may release the pressurized air to the same accessory 136, for example, when both timing cylinders 122 and respective air drive passages 120 are in fluid communication with the same accessory 136. In this way, different air drive accessories 136*a*, 136*b* or the same accessory 136 may be driven at different times or multiple times during a flush cycle.

Figure 14:
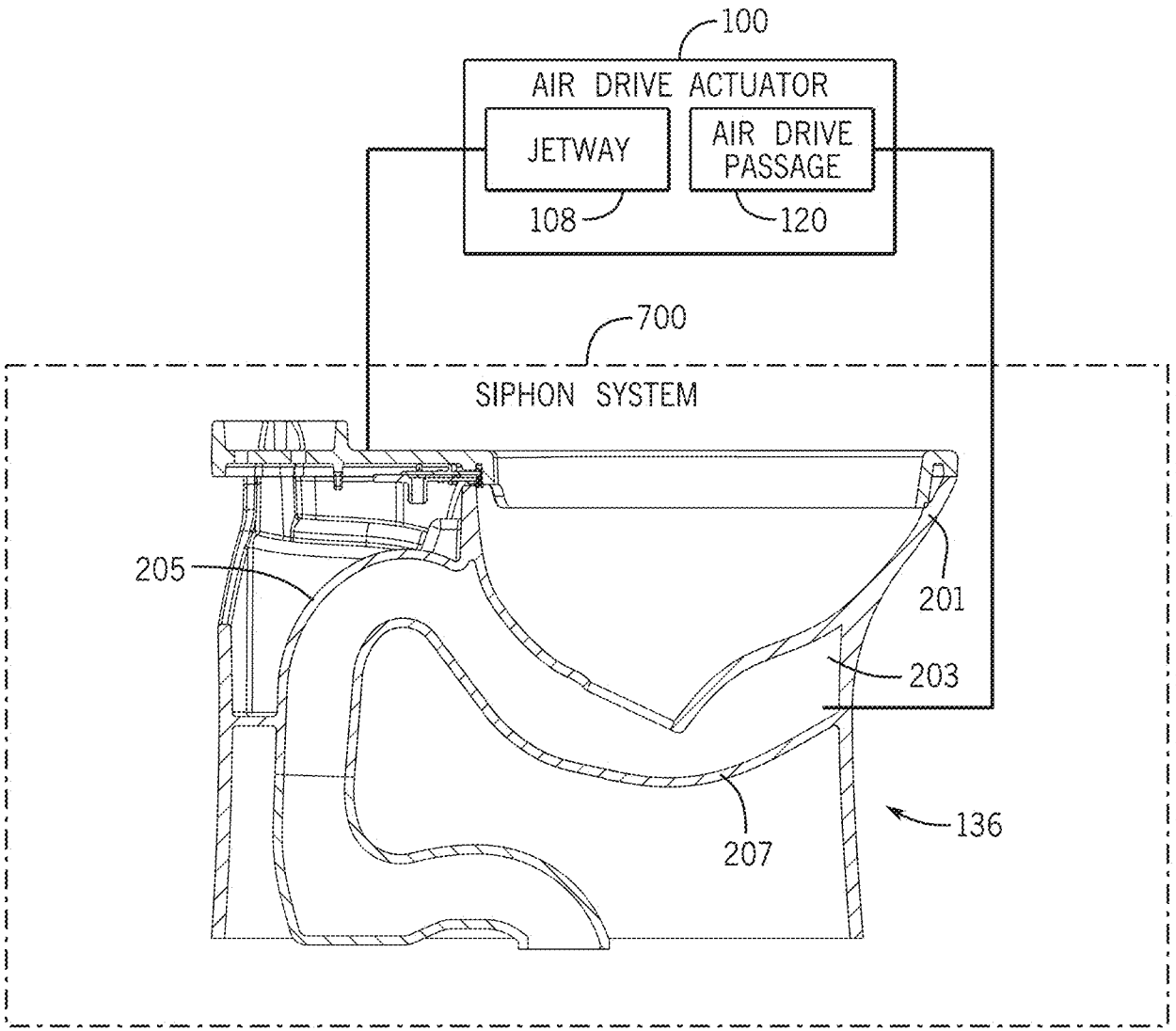
FIG. 14 illustrates an example siphon system.

FIG. 14 illustrates an example accessory 136 in communication with an air drive system 100 for a toilet. The accessory 136 may be a siphon system 700. The pressurized air output from the air drive system 100 (e.g., through the drive passage 120) is provided to a sump or cavity 203. The cavity 203 may be adjacent to the toilet bowl (e.g., touching or mounted to the toilet bowl) and just above a sump jet 207. The cavity 203 holds water and may be filled as part of the flush cycle. Pressurized air is released to the cavity 203 by actuation of the air drive system 100 (e.g., through a hose, pipe, channel or similar passage in fluid communication with the cavity 203). The pressurized air transmits a force to the water in the cavity 203, forcing the water through the sump jet 207 to break a siphon in the trapway 205 and drain the bowl of the toilet 102.

Figure 15A:
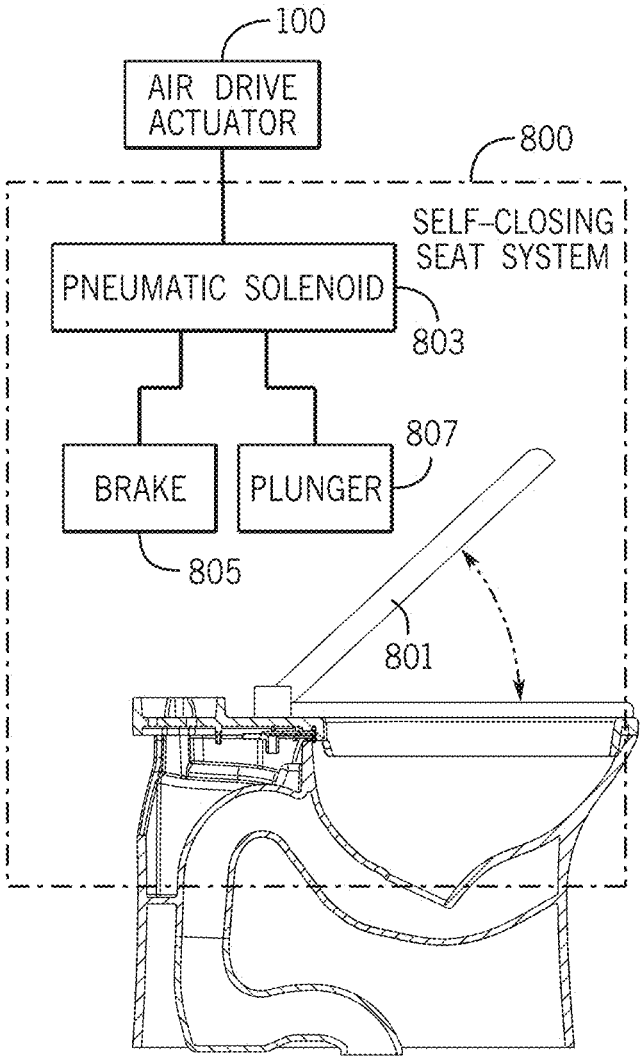
FIG. 15A illustrates an example self-closing seat system.
Figure 15B:
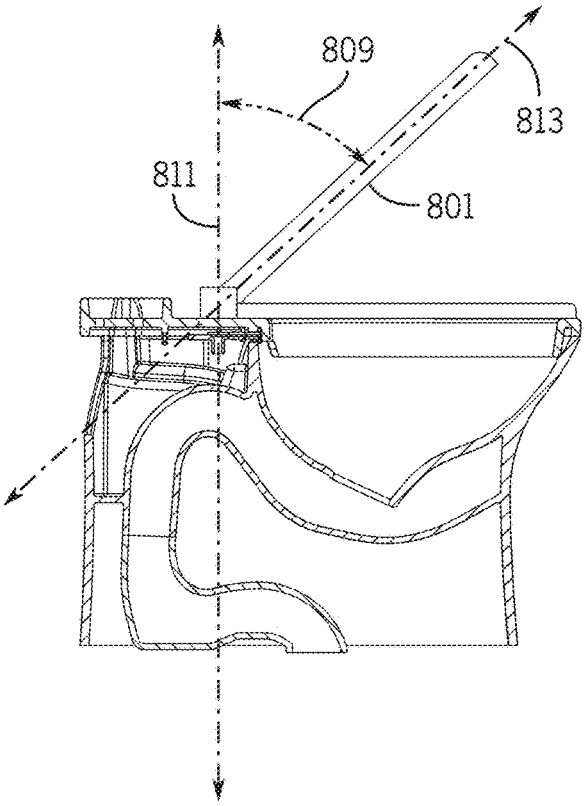
FIG. 15B illustrates an example minimum fall angle.
Figure 15C:
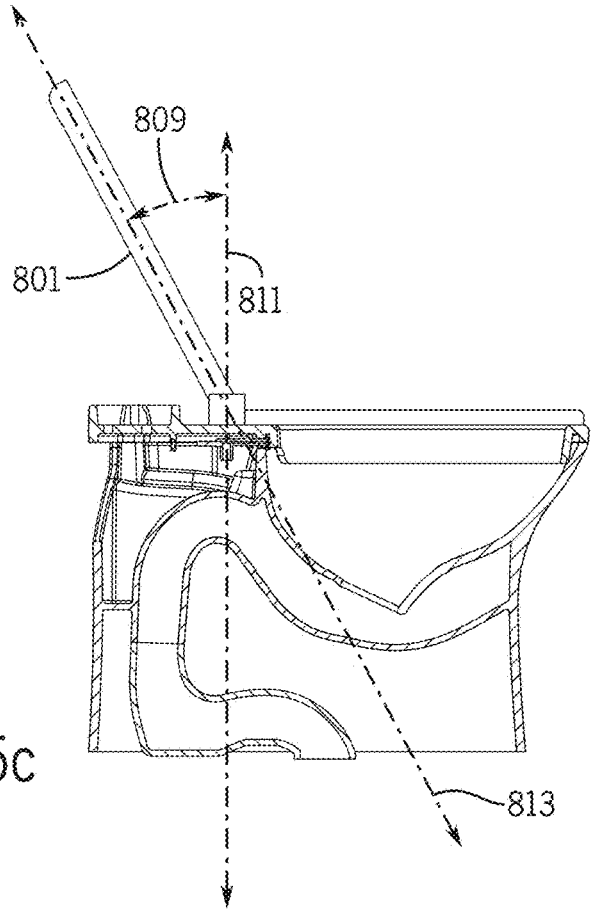
FIG. 15C illustrates another example minimum fall angle.

FIGS. 15A, 15B, and 15C illustrate an example accessory 136 in communication with an air drive system 100 for a toilet. The accessory 136 may be a self-closing seat system 800 for a toilet in fluid communication with an air drive system 100. The self-closing seat system 800 may include a seat 801 and/or cover and a pneumatic solenoid 803. In some cases, the pneumatic solenoid 803 may be mechanically coupled to the seat 801 and in fluid communication with the air drive passage 120. The solenoid 803 may be configured to move from a first position to a second position when the pressurized air is supplied to the pneumatic solenoid 803 from the air drive passage 120. Movement of the solenoid 803 results in movement of the seat 801. For example, while moving to the second position the pneumatic solenoid 803 is configured to transmit a mechanical force to the seat 801 and move the seat 801 to a closed position.

In some other cases, the self-closing toilet seat system 800 may include a brake 805. The brake 805, when engaged, may hold the seat 801 in a position (e.g. an open position). Release of the brake 805 may allow the seat 801 to return to a closed position, due to the effects of gravity or another force, such as a user moving the seat 801.

The brake 805, seat 801, and pneumatic solenoid 803 may be mechanically connected. For example, the pneumatic solenoid 803 may be in mechanical connection with the brake 805, and the brake 805 may be in mechanical connection with the seat 801, such that the pneumatic solenoid

803 is mechanically coupled to the seat 801 via the brake 805. The pneumatic solenoid 803, while in a first position, may engage, actuate, or hold the brake 805, thereby keeping the seat 801 in the open position. Movement of the solenoid 803 to the second position may allow the seat 801 to return to the closed position.

The seat 801 may be dimensioned so that gravity acting on the seat 801 may return the seat 801 to a closed position (e.g. adjacent to a rim on the toilet) from an open position (e.g. nonadjacent to the rim). In some cases, a minimum fall angle 809 is defined based on an angle between a vertical axis 811 extending from the toilet (e.g. extending from an attachment point of the seat 801 to the toilet, such as a hinge base) and a second axis 813 defined by a major axis of the seat 801 (such as an axis extending along the length or width of the seat 801. At or beyond the minimum fall angle 809, the seat 801 falls away from the vertical axis. In one example, the seat 801, while in an open position, may be positioned past the minimum fall angle 809 (e.g. with an angle greater that the minimum fall angle 809 with respect to the vertical axis). The brake 805 may hold the seat 801 in place, such that when the brake 805 is released, the seat 801 is allowed to fall by gravity acting on the seat 801.

In some cases, self-closing seat system 800 may include a plunger 807. The plunger 807 may be in mechanical communication with the pneumatic solenoid 803. Actuation of the pneumatic solenoid 803 (e.g. from a first position to a second position) results in corresponding motion of the plunger 807. When actuated by the pneumatic solenoid 803, the plunger 807 may contact or otherwise transmit a mechanical force to the seat 801. For example, when the seat 801 is resting in the open position the plunger 807 may push the seat 801 such that the seat 801 moves toward the closed position. When the seat 801 is pushed past the minimum fall angle 809 by motion of the plunger 807, the seat 801 falls closed.

Figure 16:
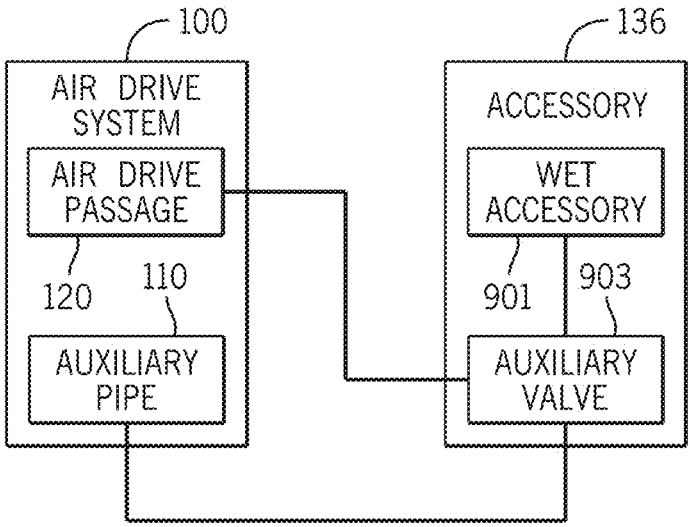
FIG. 16 illustrates an example wet accessory.

FIG. 16 illustrates an example accessory 136 in communication with an air drive system 100 for a toilet. The accessory 136 may include a wet accessory 901. For a wet accessory 901, the supply of pressurized air controls a timing of a release of water from the wet accessory 901. The release of pressurized air (e.g. through the air drive passage 120) may, for example, be controlled by the timing cylinder 122. In some cases, the accessory 136 may, in turn, control a release of water to a wet accessory 901, such as a bidet system 1000 or mister 1200. The water may be delivered to the wet accessory 901 by an auxiliary pipe 110. The accessory 136 may include an auxiliary valve 903 installed on the auxiliary pipe 110. Actuation of the auxiliary valve 903 by the pressurized air supplied from the air drive system 100 controls a flow of water to the wet accessory 901 through the auxiliary pipe 110. In this way, the timing of the operation of the wet accessory 901 is controlled based on when the pressurized air is supplied to the accessory 136 (e.g. the auxiliary valve 903).

Figure 17:
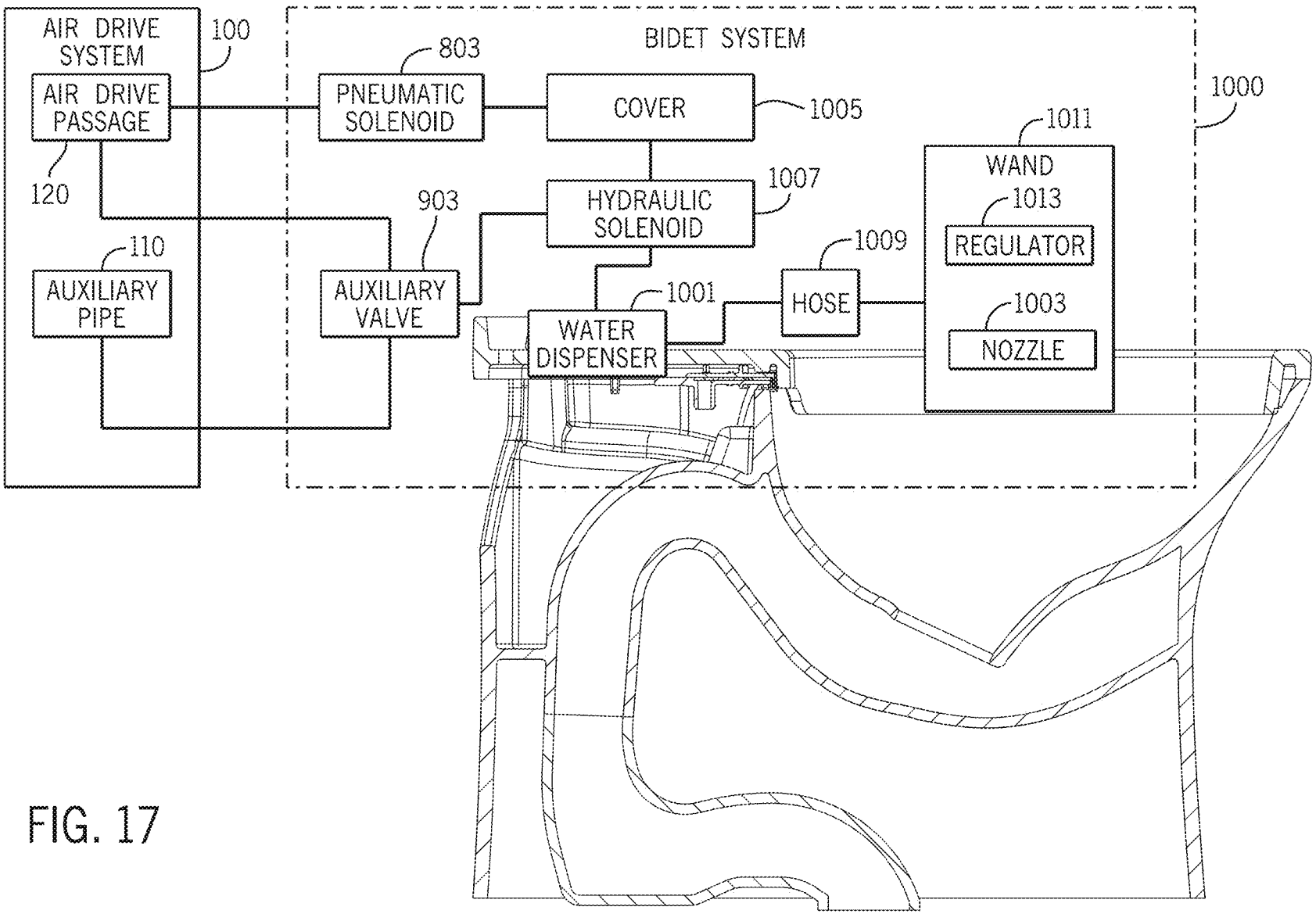
FIG. 17 illustrates an example bidet system.

FIG. 17 illustrates an example accessory 136 for a toilet. The accessory 136 may include a wet accessory 901, such as a bidet system 1000. The bidet system 1000 may include a water dispenser 1001. The water dispenser 1001 may be configured to emit a stream of water supplied to the water dispenser 1001, for example, by the auxiliary pipe 110. The bidet system 1000 may further include an auxiliary valve 903. The auxiliary valve 903, when actuated by the pressurized air from the air drive system 100, controls a flow of water to components of the bidet system 1000 (e.g. from the auxiliary pipe 110).

In some cases, the bidet system 1000 may include a nozzle 1003 in fluid communication with the water dispenser 1001. The nozzle 1003 may direct the stream of water toward a user of the toilet. For example, the nozzle 1003 may direct the stream of water upward.

In one example, the bidet system 1000 includes a cover 1005 pivotably and/or rigidly mounted to the toilet and configured to shield the water dispenser 1001 and/or the nozzle 1003. The cover 1005 is rotatable between a first position and a second position. For example, when the nozzle 1003 is not emitting the stream of water, the cover 1005 may be disposed over the nozzle 1003 (e.g. in the first position) to prevent the ingress of dirt. When the nozzle 1003 emits the stream of water, the cover 1005 may move (e.g. to a second position) away from a water discharge path of the nozzle 1003, so that the stream of water is substantially unobstructed. The movement of the cover 1005 may be hydraulically or pneumatically controlled. In some cases, the bidet system 1000 may include a pneumatic solenoid 803 in mechanical connection with the cover 1005. When the pressurized air is supplied to the pneumatic solenoid 803, the pneumatic solenoid 803 may move the cover 1005. In some other cases, the bidet may include a hydraulic solenoid 1007 in mechanical communication with the cover 1005 and in hydraulic communication with the jetway 108 (e.g. via one or more intermediaries, such as the auxiliary pipe 110). When water is supplied to the hydraulic solenoid 1007, the hydraulic solenoid 1007 may actuate and move the cover 1005.

In another example, the bidet system 1000 may include a hose 1009. The hose 1009 may connect the nozzle 1003 to the water dispenser 1001, such that the nozzle 1003 is in fluid communication with the water dispenser 1001. In some cases, the bidet system 1000 may include a wand 1011 in fluid communication with the flexible hose 1009 and the nozzle 1003. The nozzle 1003 may be disposed on the wand 1011. In this way, the user may position the wand 1011 and control the direction of the stream of water emitted by the nozzle 1003. The wand 1011 may include a regulator 1013 configured to control the flow of water output by the nozzle 1003. In some cases, the regulator 1013 may be configured to direct the stream of water in one or more directions. For example, the regulator 1013 may be set in one or more positions. In different positions of the regulator 1013, the stream of water emitted by the nozzle 1003 may be directed in different directions.

Figure 18:
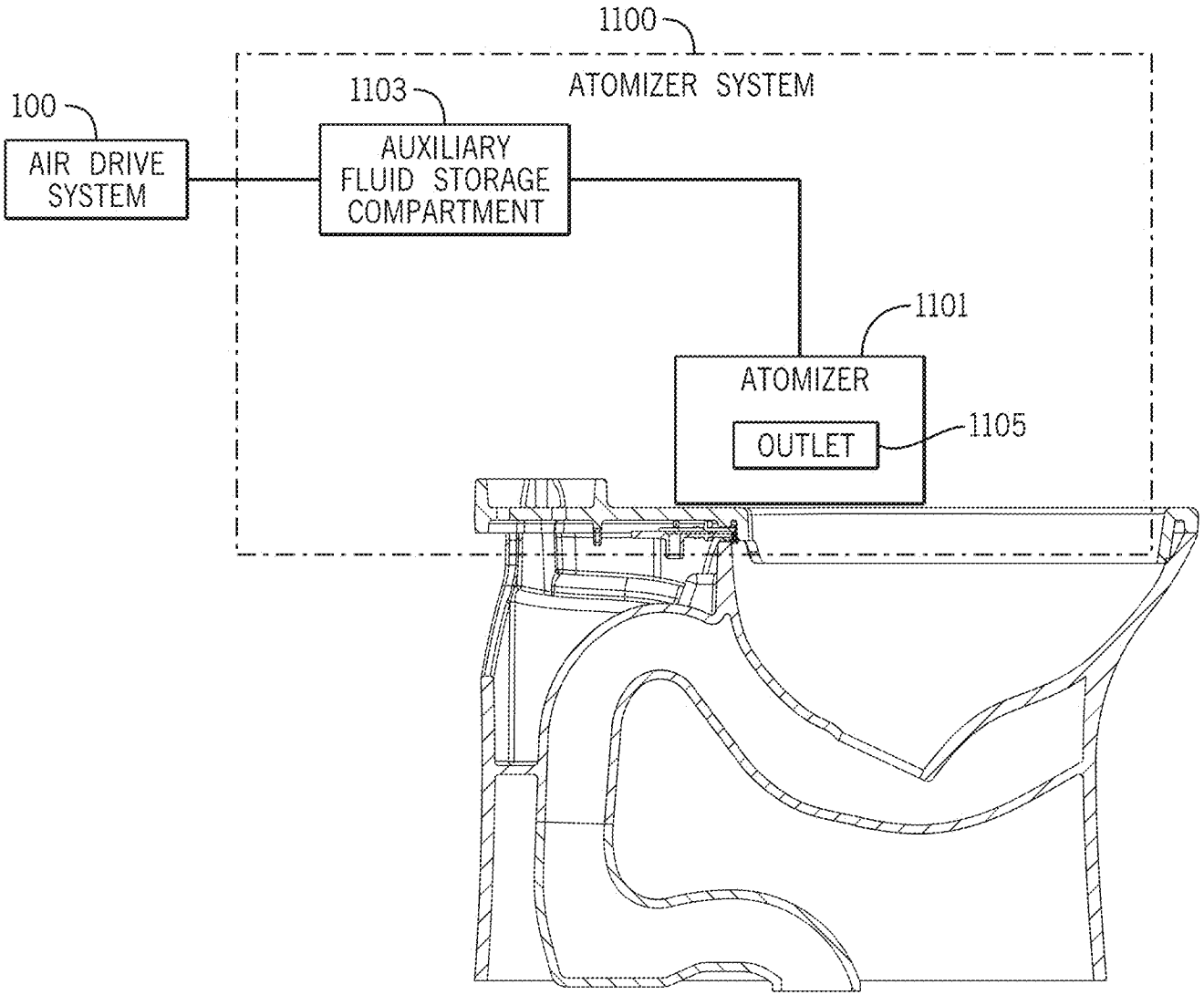
FIG. 18 illustrates an example atomizer system.

FIG. 18 illustrates an example accessory 136 for a toilet. The accessory 136 may include an atomizer system 1100 for a toilet. The atomizer system 1100 may include an atomizer 1101 configured to dispense an auxiliary fluid as a "dry fog" to trap or dilute malodorous compounds in the air and produce a pleasing aroma. When pressurized air (e.g. supplied by the air drive passage 120) passes by an auxiliary fluid stored in an auxiliary fluid storage compartment 1103 in fluid communication with the atomizer 1101 and/or the air drive passage 120, the atomizer 1101 is configured to dispense the auxiliary fluid in an atomized form. In this case, the timing of the release of the auxiliary fluid from the atomizer 1101 may be timed based on a flush cycle. The auxiliary fluid may be a disinfectant, a fragrance, or the disinfectant and the fragrance. For example, the auxiliary fluid may be hydrogen peroxide. The atomizer 1101 may include an outlet configured to dispense the auxiliary fluid toward an interior surface of a bowl or a seat 801 of the toilet.

Figure 19:
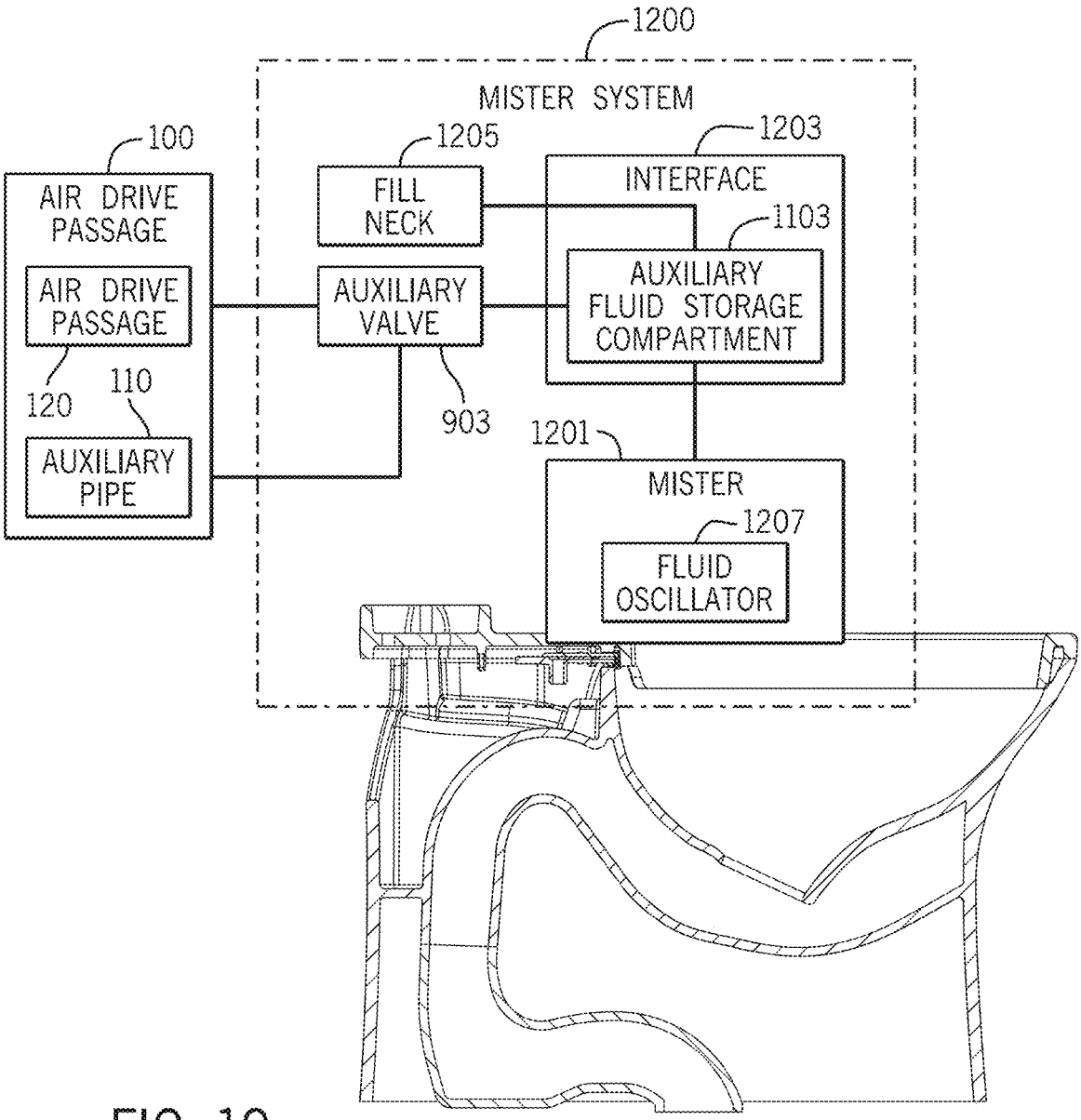
FIG. 19 illustrates an example mister system.

FIG. 19 illustrates an example accessory 136 for a toilet. The accessory 136 may include a wet accessory 901, such as a mister system 1200 for a toilet. The mister system 1200 may include a mister 1201. The mister 1201 may be configured such that the release of the pressurized air from the air drive passage 120 controls the timing (e.g. by operation of an auxiliary valve 903) of a mist released from the mister 1201. The mister 1201 may be configured to emit the flow of water as a mist applied to a surface of the toilet. In one example, the mister 1201 may be rigidly secured to the toilet. The mister 1201 may be configured to direct the mist at a surface of the toilet, such as the bowl and/or seat 801.

The mister system 1200 may include an auxiliary fluid storage compartment 1103 in fluid communication with the mister 1201 and configured to store an auxiliary fluid. The mister 1201 may be configured to dispense the auxiliary fluid as a mist in addition to or included in the flow of water. The auxiliary fluid may be a disinfectant, a fragrance, or the disinfectant and the fragrance. For example, the auxiliary fluid may be hydrogen peroxide.

In some cases, the toilet may include an interface 1203 rigidly secured to the toilet and configured to receive the auxiliary fluid storage compartment 1103. The auxiliary fluid storage compartment 1103 may be severable from the interface 1203. In this way, the auxiliary fluid may be replenished with the auxiliary fluid storage compartment 1103 removed from the toilet. In one example, an empty auxiliary fluid storage compartment 1103 may be replaced with a new auxiliary fluid storage compartment 1103 having the auxiliary fluid. By removing and/or replacing the auxiliary fluid storage compartment 1103, the auxiliary fluid may be more conveniently replenished by a user.

In some other cases, the toilet may include a fill neck 1205 in fluid communication with the auxiliary fluid storage compartment 1103. The fill neck 1205 may be accessible from a surface of the toilet. When a level of the auxiliary fluid in the auxiliary fluid storage compartment 1103 is low, more auxiliary fluid may be added to the auxiliary fluid storage compartment 1103 via the fill neck 1205. The fill neck 1205 allows for refilling the auxiliary fluid storage compartment 1103 from a source of the auxiliary fluid external to the toilet. A user may, for example, store a container of the auxiliary fluid and fill the auxiliary fluid storage compartment 1103 when a fluid level is low.

In still some other cases, the toilet may include both the interface 1203 configured to receive the auxiliary fluid storage compartment 1103, and the fill neck 1205 in fluid communication with the auxiliary fluid storage compartment 1103. In this arrangement, a user has multiple convenient methods to refill the auxiliary fluid storage compartment 1103.

The mister 1201 may include a fluidic oscillator 1207. The fluidic oscillator 1207 is a device that directs a stream of water along different paths based on a configuration of elements of the fluidic oscillator 1207. The fluidic oscillator 1207 may direct the water without any external force (e.g. a cam system) beyond the water supplied to the fluidic oscillator 1207. The fluidic oscillator 1207 may include an inlet in fluid communication with the flow of water, a chamber in fluid communication with the inlet, an outlet in fluid communication with the chamber, and/or a plurality of feedback channels disposed in the chamber between the inlet and the outlet.

Figure 20:
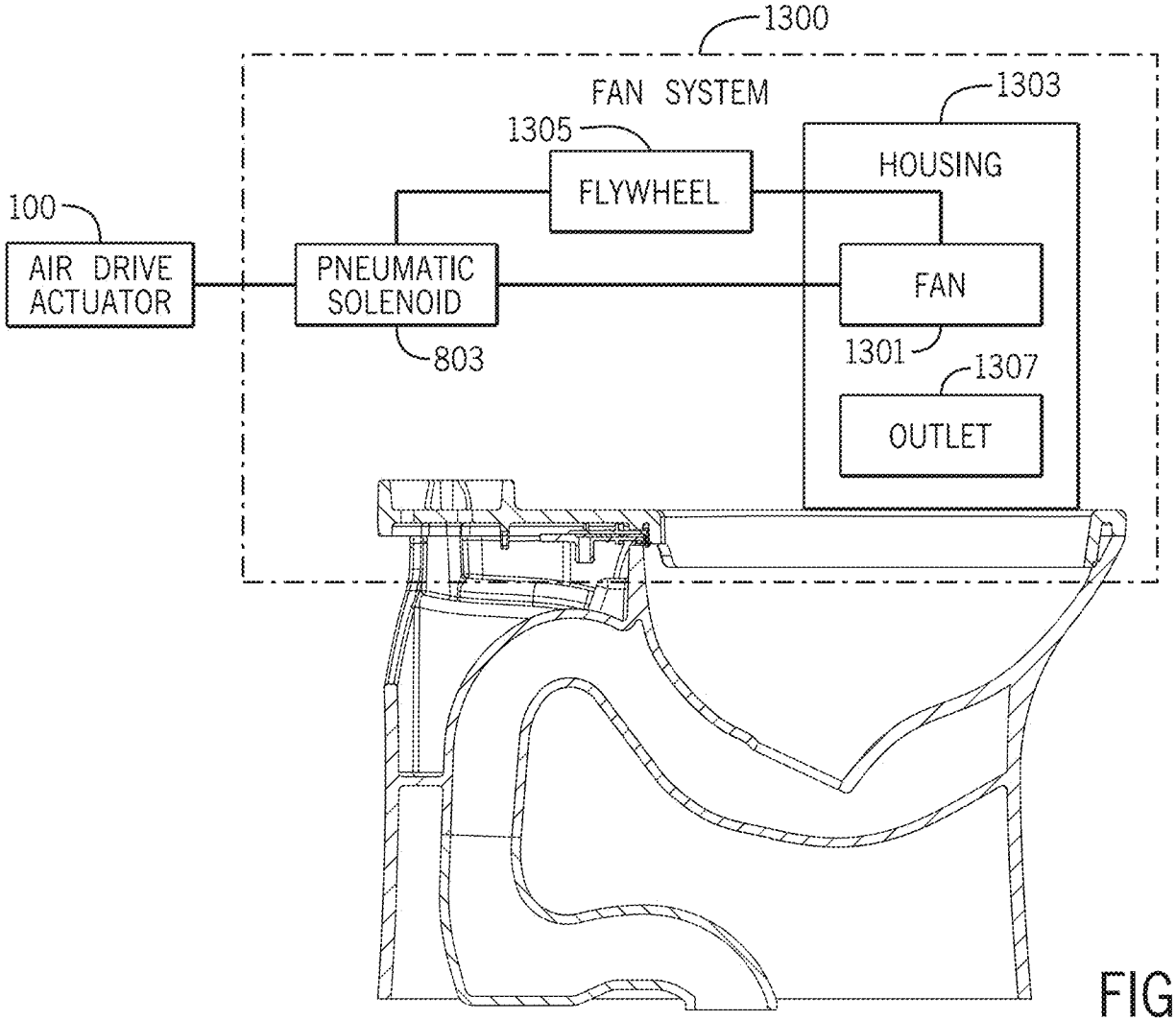
FIG. 20 illustrates an example fan system.

FIG. 20 illustrates an example accessory 136 for a toilet. The accessory 136 may include a fan system 1300 for a toilet. The fan system 1300 may include a fan 1301 and a pneumatic solenoid 803 coupled to the fan 1301 and in fluid communication with the air drive passage 120. The pneumatic solenoid 803, when supplied with pressurized air from the air drive passage 120, moves from a first position to a second position and drives the fan 1301. The fan system 1300 may include a flywheel mechanically coupled to the fan 1301 and the pneumatic solenoid 803. Movement of the pneumatic solenoid 803 causes rotational movement of the flywheel. Via the mechanical coupling of the fan 1301 and the flywheel, rotation of the flywheel causes rotation of the fan 1301. A housing may at least partially enclose the fan 1301. An outlet 1307 may be disposed on the housing 1303 and directed toward an interior surface of a bowl or a seat 801 of the toilet. Based on the positioning of the outlet 1307, a direction of air blown by the fan 1301 may be controlled.

Figure 21:
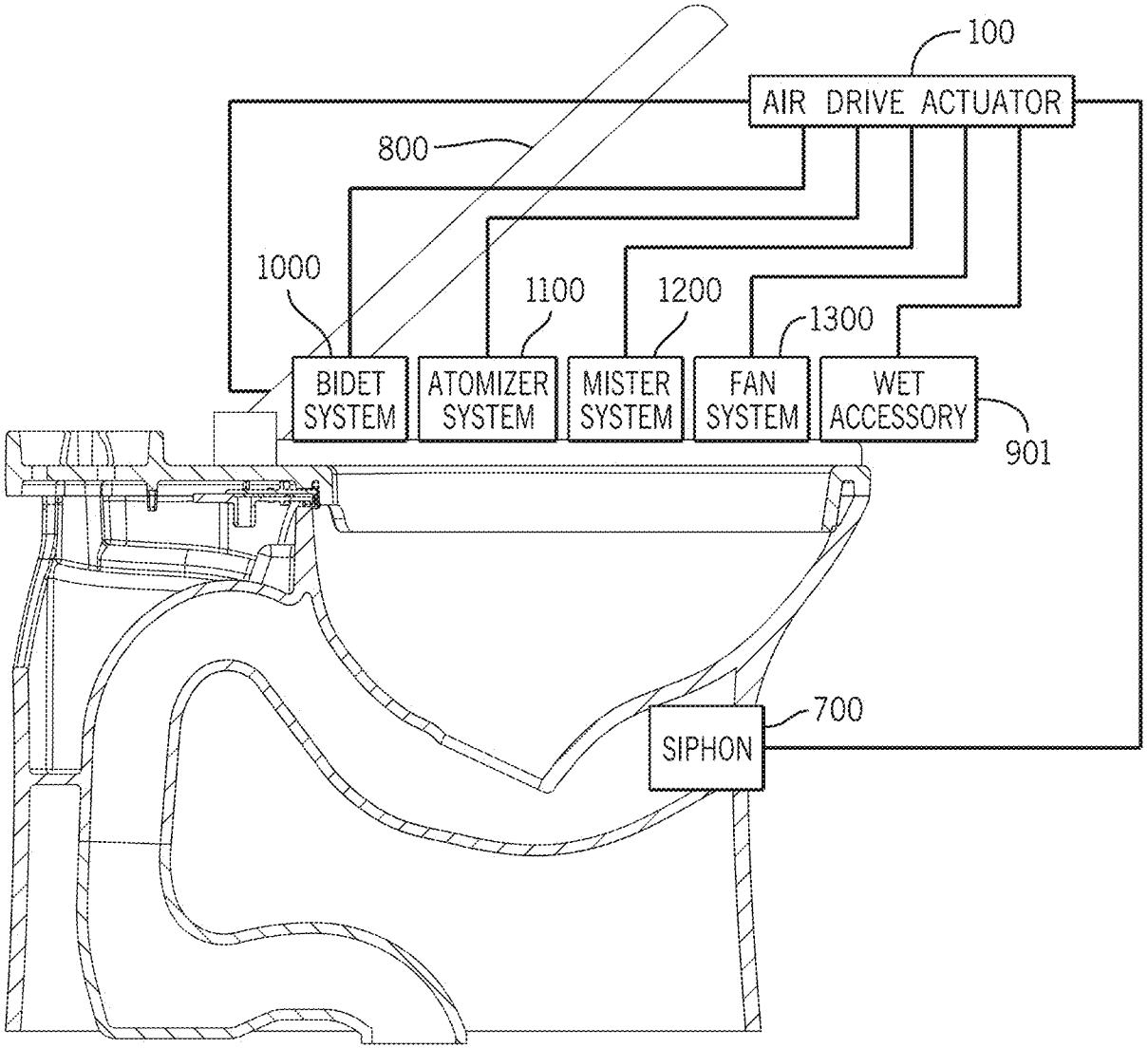
FIG. 21 illustrates an example of multiple accessories for a toilet.

FIG. 21 illustrates an example of multiple accessories for a toilet. The air drive system 100 may supply pressurized air to one or more accessories 136. For example, the air drive system 100 may drive a siphon system 700, a self-closing seat system 800 (e.g., including a seat and a lid that operate independently), a wet accessory 901, a bidet system 1000, an atomizer system 1100, a mister system 1200, a fan system 1300, or a combination thereof. In this way, an air drive system 100 including one or more of a compression cylinder 114, timing cylinder 122, or a combination thereof, may drive the accessories 136 with the pressurized air created by the flow of water through the jetway 108.

The accessories 136 may be activated at different times during or after a flush cycle, allowing for a comprehensive sanitary environment "powered" by water. In one example, an accessory 136, such as a bidet system 1000, is automatically activated in response to the toilet 102 being flushed. The water released by the flush may fill a compression cylinder 114 and/or a timing cylinder so that the bidet system 1000 is activated following the flush. In another example, multiple accessories 136, such as a mister system 1200 and a fan system 1300, are automatically activated in response to the flush. The multiple accessories 136 may operate at a same time after the flush, such that the release of pressurized air to the accessories 136 is coordinated. Additionally or alternatively, the multiple accessories 136 may be operated at different times after the flush, such that the pressurized air is supplied to the multiple accessories 136 at different times.

In some other cases, operation of the accessories 136 may be by an input, such as input received from a user, a sensor, and/or a controller (e.g. the controller 301 described with respect to FIG. 22). The input may control operation of the accessories 136 in addition to or instead of the control of the accessories 136 provided by the flush. In some cases, the input may activate or deactivate one or more of the accessories 136. For example, a user, via a switch or other user interface device (such as a device part of or in communication with the controller 301), may input whether an accessory 136 is activated or deactivated. In this way, a user may control operation of the accessories 136 according to preference. In another example, operation of the accessories 136 is activated or deactivated based on input from another sensor. Operation of the self-closing seat system 800 may be deactivated while a sensor detects the presence of a user on the toilet 102.

In one example, a flush may provide pressurized air to the bidet system 1000. However, the bidet system 1000 may not operate until an input is provided. The input may be received, for example, from a sensor detecting a seated position of the user, from a button pressed by the user, or from a controller 301. In another example, flush-controlled accessories 136 and input-controlled accessories may be used together for a toilet 102. A first accessory 136, such as the siphon 700, may be operated automatically based on the flush, while a second accessory 136, such as a fan system 1300, may be operated based on the input.

A connection between the accessories 136 and an input source (e.g. sensor, user input, and/or controller 301) may allow for input-based control of the operation of the accessories 136. A connection (e.g. electric, pneumatic, hydraulic, and/or mechanical) between the input source and a valve may control the operation of one or more accessories 136. For example, a valve may be in communication with the input source and configured to stop or allow a flow of water and/or pressurized air to an accessory 136 based on the input.

FIG. 22 illustrates an example an example controller 301 for an air drive system. The controller 301 may include a processor 300, a memory 352, and a communication interface 353 for interfacing with devices or to the internet and/or other networks 346. In addition to the communication interface 353. The components of the control system 301 may communicate using bus 348.

Optionally, the control system 301 may include an input device 355 and/or a sensing circuit. The input device 355 may include the switch 150, a touchscreen coupled to or integrated with the mirror, a keyboard, a microphone for voice inputs, a camera for gesture inputs, and/or another mechanism.

Optionally, the control system 301 may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be included integrated with the toilet or an external device such as a remote control or tablet. The display 350 may be combined with the user input device 355.

Figure 23:
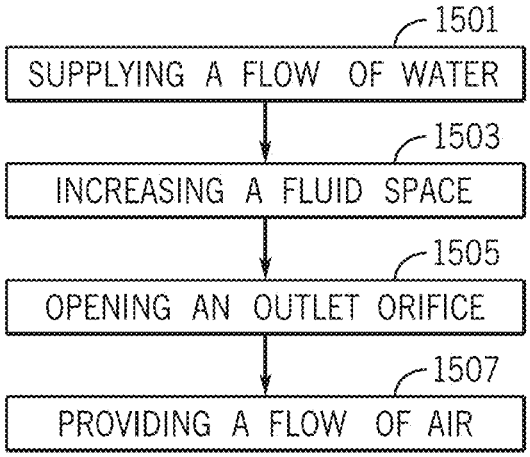
FIG. 23 illustrates an example flowchart for operation of the air drive system.
Figure 24:
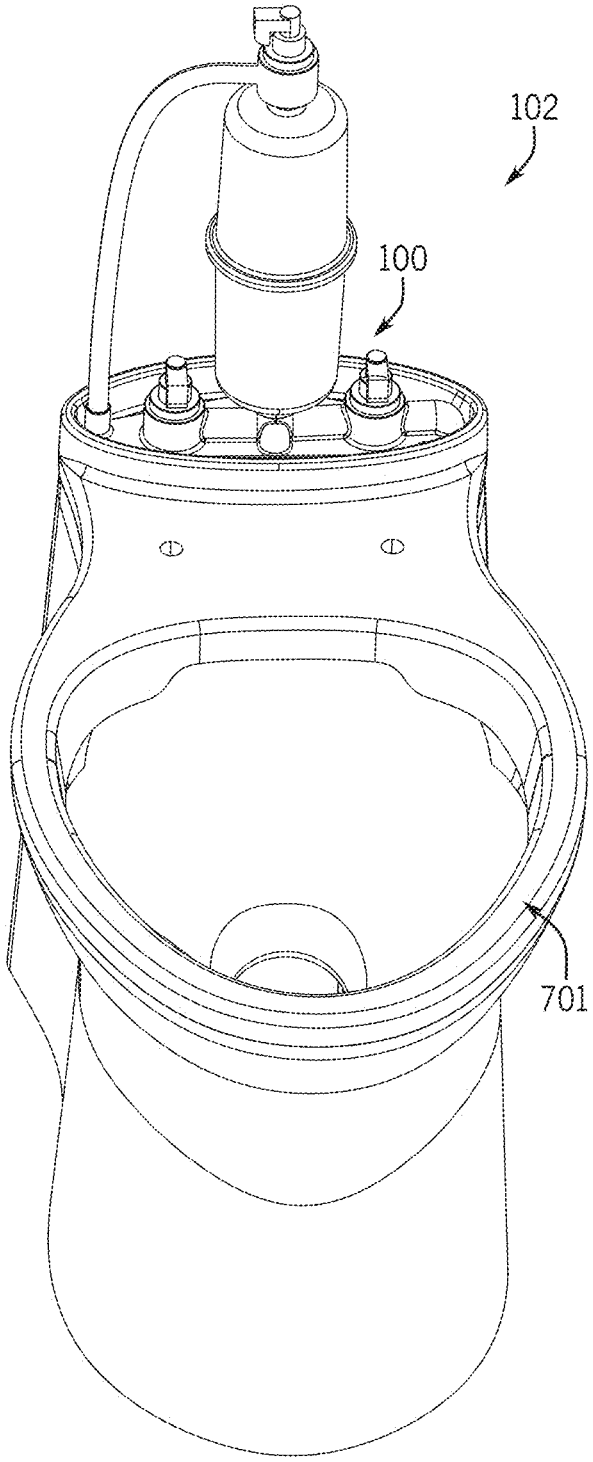
FIG. 24 illustrates another embodiment of an air drive system for a sump jet.

FIG. 23 illustrates an example flowchart for operation of the air drive system 100 of the toilet 102. Additional, different, or fewer acts may be included.

In act 1501, a flow of water is supplied through a jetway 108. The water may flow past a base orifice 116, 124 of a compression cylinder 114 and/or timing cylinder 122. In one example, the base orifice 116 of the compression cylinder 114 is located downstream of the base orifice 124 of the timing cylinder 122, such that the water flows to the compression cylinder 114 after the compression cylinder 122. In another example, the base orifice 116 of the compression cylinder 114 is located upstream of the base orifice 124 of the timing cylinder 122, such that the water flows to the compression cylinder 114 before the compression cylinder 122.

In act 1503, the action of the water passing by the orifice causes, in one case, an air pressure to build in the cylinder 114, 122. Additionally or alternatively, the action of the water passing by the orifice causes an increase in a fluid space of the cylinder 114, 122. Because the compression cylinder 114 and or timing cylinder 122 may have a fixed volume, the addition of air into the cylinder 114, 122 increases an associated pressure. As water enters the cylinder, for example, the fluid space increases and may compress air in the cylinder 114, 122, thereby raising the pressure.

In act 1505, an outlet orifice adjoining the air space is opened in response to the increase in the fluid space or the air pressure of the air space. Pressure increasing in the cylinder 114, 122 may exert a force against a piston 134. When the force is sufficient, the piston may move and open the outlet orifice 126, 118. A float 150 may rise as the fluid space increases. As the float rises, a piston 134 coupled with the float may open the outlet orifice 126, 118.

In act 1507, in response to opening the outlet orifice, pressurized air is provided from the cylinders 114, 122. The pressurized air may escape through an air drive passage 120 and be delivered to one or more accessories 136 associated with the toilet 102. The pressurized air may drive, for example, a siphon system 700, a self-closing seat system 800, a wet accessory 901, a bidet system 1000, an atomizer system 1100, a mister system 1200, a fan system 1300, or a combination thereof. By acts 1501, 1503, 1505, and 1507, a flush of the toilet pressurizes air in at least one cylinder 114, 116 and directs the air to operate an accessory 136.

FIGS. 24-27 illustrate another example toilet 102 having an air drive system 100. The toilet 102 includes a vitreous body 701. The vitreous body includes a system of air passages through the toilet 102 so that the pressurized air from the air drive system 100 reaches a water cavity or a sump jet and propels air or water into the sump to create a siphon in the trapway or otherwise flush the toilet 102. FIG. 17 illustrates the cavity 203 connected to the sump by a jet orifice 214.

Figure 25:
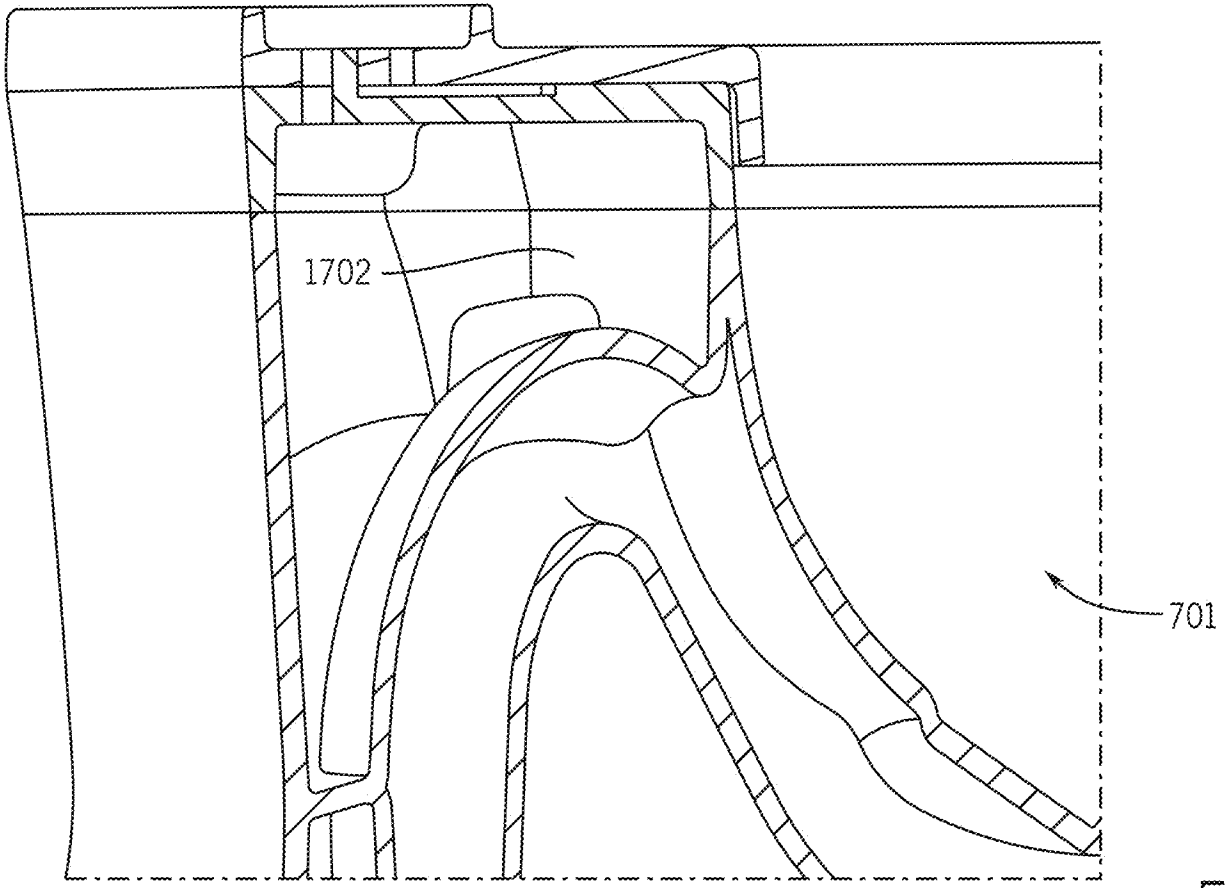
FIGS. 25-27 illustrate an air channel to the cavity for the sump jet.
Figure 26:
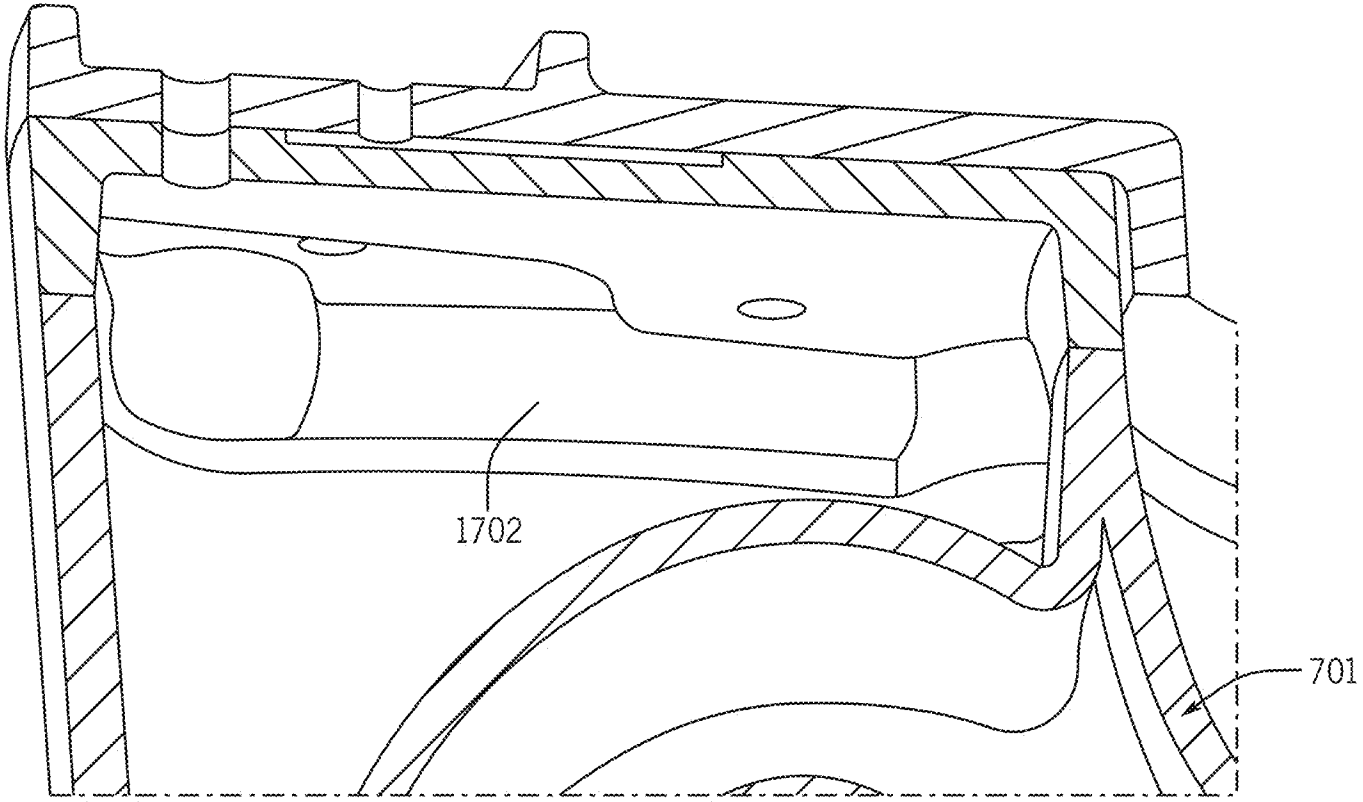
Figure 27:
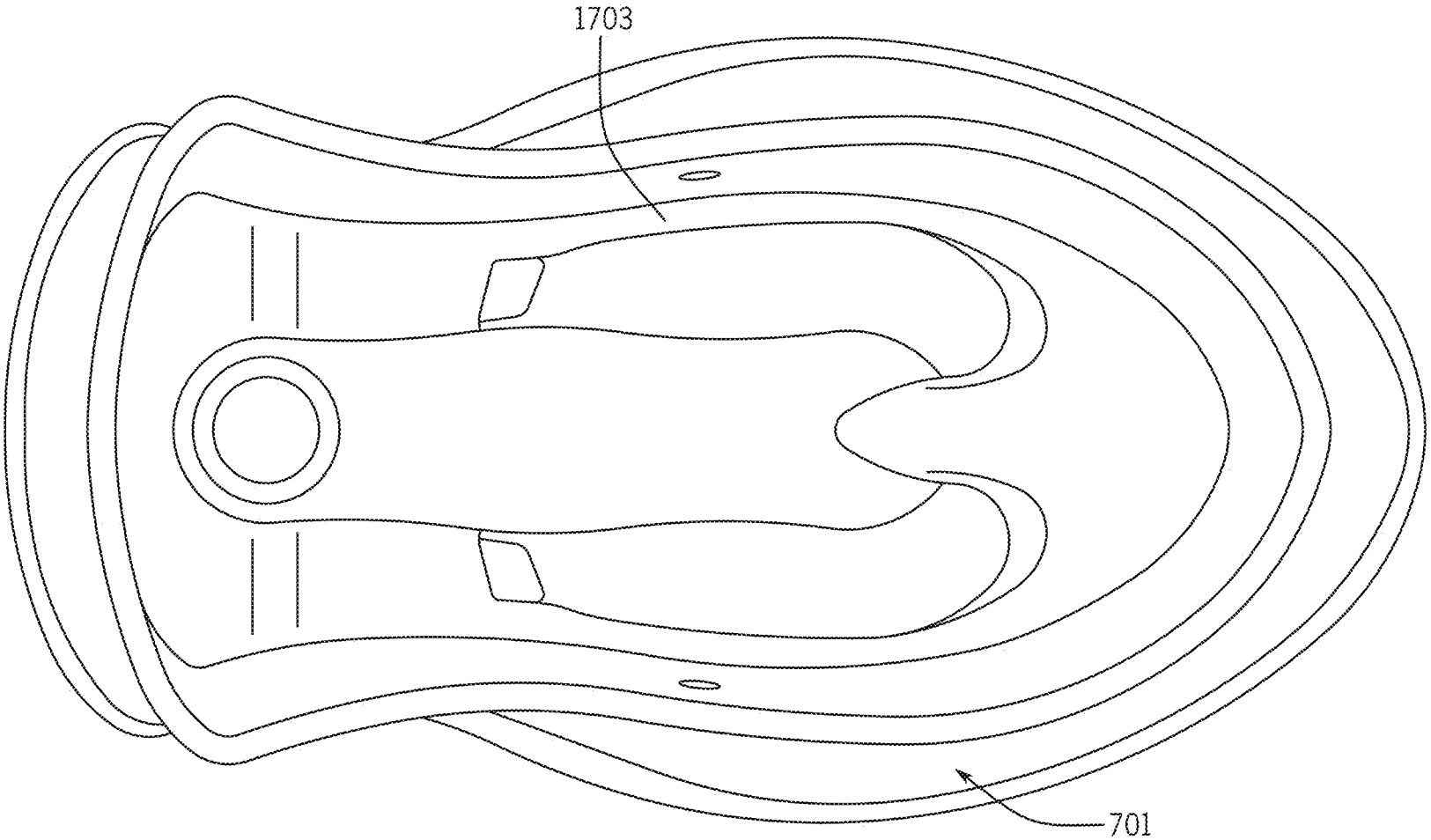

FIGS. 25-27 illustrate air conduits for the toilet 102 having an air drive system 100. Multiple openings (e.g., as illustrated in FIG. 3) in the flush engine (e.g., vitreous body 701) connects the air drive system 100 to one or more air channels in the flush engine. For example, FIG. 25 illustrates an air channel 1702 that is vertically arranged to provide the flow of air from the opening 1701 into a predetermined depth of the flush engine. FIG. 26 illustrate another portion of the air channel 1702 horizontally arrange to provide the flow of air to the front of the flush engine. FIG. 27 illustrates that one more lower air channels 1703 connect the air channel 1702 to the water cavity or sump jet.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. An air drive system for a toilet, the air drive system comprising:

a chamber including an air space and a fluid space, wherein as the fluid space increases in volume, the air space decreases in volume;

a base orifice of the chamber in fluid communication with the air space;

an outlet orifice of the chamber adjacent to the air space;

a water passage configured to carry a flow of water to the base orifice, wherein the flow of water increases an air pressure of the air space;

an air drive passage configured to supply pressurized air from the chamber to a toilet; and a float between the fluid space and the air space in the chamber, wherein the float rises in response to the increase in the fluid space in the chamber, and wherein the float actuates a piston to open a valve to supply air from the air space of the chamber to the air drive passage.

2. The air drive system of claim 1, wherein the base orifice adjoins the fluid space, and wherein the flow of water increases a volume of the fluid space of the chamber.

3. The air drive system of claim 1, further comprising:

a vent in fluid communication with the air drive passage, wherein the vent is configured to release the pressurized air from the air drive passage.

4. The air drive system of claim 1, further comprising:

a sump disposed at a bottom of a bowl of the toilet and configured to store a first volume of water; and a trap of the toilet in fluid communication with the sump, wherein the trap is configured to store a second volume of water providing a sanitary seal for the toilet.

5. The air drive system of claim 4, wherein the air drive passage is configured to supply pressurized air from the chamber to move at least a portion of the first volume of water from the sump to the trap.

6. The air drive system of claim 5, wherein the first volume of water displaces the second volume of water to break the sanitary seal to flush the toilet.

7. The air drive system of claim 4, wherein the water passage is configured to provide the first volume of water to the sump from the flow of water carried by the water passage.

8. The air drive system of claim 4, further comprising:

a rim jet in fluid communication with the water passage and adjacent to the bowl, wherein the water passage is configured to supply the first volume of water to the bowl or the sump through the rim jet.

9. The air drive system of claim 8, wherein the first volume of water stored in the sump is greater than the second volume of water disposed in the trap.

10. The air drive system of claim 4, wherein the trap comprises a first pipe section, a vertical section, and an outlet pipe, wherein a space in the vertical section, at least partially, defines the volume of the sanitary seal.

11. The air drive system of claim 1, wherein the pressurized air from the chamber is provided to the toilet in response to a user input.

12. The air drive system of claim 1, wherein the pressurized air from the chamber is provided to the toilet in response to a flush cycle.

13. The air drive system of claim 1, further comprising:

a jet in fluid communication with the air drive passage to provide the pressurized air to flush the toilet.

14. A method for flushing a toilet comprising:

supplying a flow of water to a base opening of a compression cylinder, wherein the flow of water increases air pressure in an air space of the compression cylinder and increases a water level in the compression cylinder;

opening an outlet orifice adjoining the air space, the outlet opened through movement of a float in response to the water level in the compression cylinder; and providing, in response to opening the outlet orifice, a flow of air through an air drive passage to an air driven device associated with the toilet.

15. The method of claim 14, wherein the outlet orifice is opened in response to a user input.

16. The method of claim 14, wherein the air driven device is an air jet for flushing the toilet.

17. The method of claim 14, wherein the air driven device breaks a siphon seal.

18. The method of claim 14, wherein the flow of water is provided, at least in part, to a rim aperture.

19. A toilet comprising:

a chamber with an air space and a fluid space, wherein as the fluid space increases in volume, the air space decreases in volume;

a base orifice of the chamber in fluid communication with the air space;

an outlet orifice of the chamber adjacent to the air space;

a water passage configured to provide water to the chamber, wherein the water increases an air pressure of the air space;

an air drive passage configured to supply pressurized air from the chamber to flush the toilet; and a float between the fluid space and the air space in the chamber, wherein the float rises in response to the increase in the fluid space in the chamber, and wherein the float actuates a piston to open a valve to supply air from the air space of the chamber to the air drive passage.

* * * * *